US008083012B2

(12) United States Patent
Voronin et al.

(10) Patent No.: US 8,083,012 B2
(45) Date of Patent: Dec. 27, 2011

(54) DIAMOND BONDED CONSTRUCTION WITH THERMALLY STABLE REGION

(75) Inventors: Georgiy Voronin, Orem, UT (US); J. Daniel Belnap, Pleasant Grove, UT (US); Feng Yu, Pleasant Grove, UT (US); Benjamin Randall, Spanish Fork, UT (US)

(73) Assignee: Smith International, Inc., Houston, TX (US)

( * ) Notice: Subject to any disclaimer, the term of this patent is extended or adjusted under 35 U.S.C. 154(b) by 518 days.

(21) Appl. No.: 12/245,582

(22) Filed: Oct. 3, 2008

(65) Prior Publication Data

US 2010/0084197 A1 Apr. 8, 2010

(51) Int. Cl.
*E21B 10/46* (2006.01)

(52) U.S. Cl. ..... 175/374; 175/434; 51/307

(58) Field of Classification Search ..... 175/374, 175/428, 434; 51/307
See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | Lai |
| 3,233,988 | A | 2/1966 | Wentorf, Jr. et al. |
| 3,745,623 | A | 7/1973 | Wentorf, Jr. et al. |
| 4,108,614 | A | 8/1978 | Mitchell |
| 4,109,737 | A | 8/1978 | Bovenkerk |
| 4,151,686 | A | 5/1979 | Lee et al. |
| 4,224,380 | A | 9/1980 | Bovenkerk et al. |
| 4,225,322 | A | 9/1980 | Knemeyer |
| 4,255,165 | A | 3/1981 | Dennis et al. |
| 4,268,276 | A | 5/1981 | Bovenkerk |
| 4,288,248 | A | 9/1981 | Bovenkerk et al. |
| 4,303,442 | A | 12/1981 | Hara et al. |
| 4,311,490 | A | 1/1982 | Bovenkerk et al. |
| 4,373,593 | A | 2/1983 | Phaal et al. |
| 4,387,287 | A | 6/1983 | Marazzi |
| 4,412,980 | A | 11/1983 | Tsuji et al. |
| 4,440,246 | A | 4/1984 | Jurgens |

(Continued)

FOREIGN PATENT DOCUMENTS

CA 2 535 387 A1 8/2006

(Continued)

OTHER PUBLICATIONS

Search Report for British Patent Application No. GB 09 16199.3, Jan. 20, 2010, total 5 pages.

(Continued)

*Primary Examiner* — William P Neuder
(74) *Attorney, Agent, or Firm* — Connolly Bove Lodge & Hutz LLP

(57) ABSTRACT

Diamond bonded constructions comprise a polycrystalline diamond body having a matrix phase of bonded-together diamond grains and a plurality of interstitial regions between the diamond grains including a catalyst material used to form the diamond body disposed within the interstitial regions. A sintered thermally stable diamond element is disposed within and bonded to the diamond body, and is configured and positioned to form part of a working surface. The thermally stable diamond element is bonded to the polycrystalline diamond body, and a substrate is bonded to the polycrystalline diamond body. The thermally stable diamond element comprises a plurality of bonded-together diamond grains and interstitial regions, wherein the interstitial regions are substantially free of a catalyst material used to make or sinter the thermally stable diamond element. A barrier material may be disposed over or infiltrated into one or more surfaces of the thermally stable diamond element.

51 Claims, 9 Drawing Sheets

U.S. PATENT DOCUMENTS

| | | | |
|---|---|---|---|
| 4,481,016 | A | 11/1984 | Campbell et al. |
| 4,486,286 | A | 12/1984 | Lewin et al. |
| 4,498,549 | A | 2/1985 | Jurgens |
| 4,504,519 | A | 3/1985 | Zelez |
| 4,505,746 | A | 3/1985 | Nakai et al. |
| 4,515,226 | A | 5/1985 | Mengel et al. |
| 4,522,633 | A | 6/1985 | Dyer |
| 4,525,179 | A | 6/1985 | Gigl |
| 4,534,773 | A | 8/1985 | Phaal et al. |
| 4,556,403 | A | 12/1985 | Almond et al. |
| 4,560,014 | A | 12/1985 | Geczy |
| 4,570,726 | A | 2/1986 | Hall |
| 4,572,722 | A | 2/1986 | Dyer |
| 4,602,691 | A | 7/1986 | Weaver |
| 4,604,106 | A | 8/1986 | Hall |
| 4,605,343 | A | 8/1986 | Hibbs, Jr. et al. |
| 4,606,738 | A | 8/1986 | Hayden |
| 4,621,031 | A | 11/1986 | Scruggs |
| 4,636,253 | A | 1/1987 | Nakai et al. |
| 4,645,977 | A | 2/1987 | Kurokawa et al. |
| 4,662,348 | A | 5/1987 | Hall et al. |
| 4,664,705 | A | 5/1987 | Horton et al. |
| 4,670,025 | A | 6/1987 | Pipkin |
| 4,707,384 | A | 11/1987 | Schachner et al. |
| 4,726,718 | A | 2/1988 | Meskin et al. |
| 4,764,434 | A | 8/1988 | Aronsson et al. |
| 4,766,040 | A | 8/1988 | Hillert et al. |
| 4,776,861 | A | 10/1988 | Frushour |
| 4,784,023 | A | 11/1988 | Dennis |
| 4,792,001 | A | 12/1988 | Zijsling |
| 4,793,828 | A | 12/1988 | Burnand |
| 4,797,138 | A | 1/1989 | Komanduri |
| 4,797,241 | A | 1/1989 | Peterson et al. |
| 4,798,026 | A | 1/1989 | Cerceau |
| 4,802,539 | A | 2/1989 | Hall et al. |
| 4,807,402 | A | 2/1989 | Rai |
| 4,828,582 | A | 5/1989 | Frushour |
| 4,844,185 | A | 7/1989 | Newton, Jr. et al. |
| 4,850,523 | A | 7/1989 | Slutz |
| 4,861,350 | A | 8/1989 | Phaal et al. |
| 4,871,377 | A | 10/1989 | Frushour |
| 4,882,128 | A | 11/1989 | Hukvari et al. |
| 4,899,922 | A | 2/1990 | Slutz et al. |
| 4,919,220 | A | 4/1990 | Fuller et al. |
| 4,931,068 | A | 6/1990 | Dismukes et al. |
| 4,933,529 | A | 6/1990 | Saville et al. |
| 4,940,180 | A | 7/1990 | Martell |
| 4,943,488 | A | 7/1990 | Sung et al. |
| 4,944,772 | A | 7/1990 | Cho |
| 4,976,324 | A | 12/1990 | Tibbitts |
| 4,985,051 | A | 1/1991 | Ringwood |
| 5,011,514 | A | 4/1991 | Cho et al. |
| 5,027,912 | A | 7/1991 | Juergens |
| 5,028,177 | A | 7/1991 | Meskin et al. |
| 5,030,276 | A | 7/1991 | Sung et al. |
| 5,032,147 | A | 7/1991 | Frushour |
| 5,037,704 | A | 8/1991 | Nakai et al. |
| 5,068,148 | A | 11/1991 | Nakahara et al. |
| 5,092,687 | A | 3/1992 | Hall |
| 5,116,568 | A | 5/1992 | Sung et al. |
| 5,127,923 | A | 7/1992 | Bunting et al. |
| 5,135,061 | A | 8/1992 | Newton, Jr. |
| 5,176,720 | A | 1/1993 | Martell et al. |
| 5,186,725 | A | 2/1993 | Martell et al. |
| 5,199,832 | A | 4/1993 | Meskin et al. |
| 5,205,684 | A | 4/1993 | Meskin et al. |
| 5,213,248 | A | 5/1993 | Horton et al. |
| 5,238,074 | A | 8/1993 | Tibbitts et al. |
| 5,264,283 | A | 11/1993 | Waldenstrom et al. |
| 5,337,844 | A | 8/1994 | Tibbitts |
| 5,369,034 | A | 11/1994 | Hargett et al. |
| 5,370,195 | A | 12/1994 | Keshavan et al. |
| 5,379,853 | A | 1/1995 | Lockwood et al. |
| 5,439,492 | A | 8/1995 | Anthony et al. |
| 5,464,068 | A | 11/1995 | Najafi-Sani |
| 5,468,268 | A | 11/1995 | Tank et al. |
| 5,496,638 | A | 3/1996 | Waldenstrom et al. |
| 5,505,748 | A | 4/1996 | Tank et al. |
| 5,510,193 | A | 4/1996 | Cerutti et al. |
| 5,523,121 | A | 6/1996 | Anthony et al. |
| 5,524,719 | A | 6/1996 | Dennis |
| 5,560,716 | A | 10/1996 | Tank et al. |
| 5,590,729 | A | 1/1997 | Cooley et al. |
| 5,592,995 | A | 1/1997 | Scott et al. |
| 5,607,024 | A | 3/1997 | Keith et al. |
| 5,620,382 | A | 4/1997 | Cho et al. |
| 5,624,068 | A | 4/1997 | Waldenstrom et al. |
| 5,645,617 | A | 7/1997 | Frushour |
| 5,667,028 | A | 9/1997 | Truax et al. |
| 5,718,948 | A | 2/1998 | Ederyd et al. |
| 5,722,497 | A | 3/1998 | Gum et al. |
| 5,722,499 | A | 3/1998 | Nguyen et al. |
| 5,776,615 | A | 7/1998 | Wong et al. |
| 5,833,021 | A | 11/1998 | Mensa-Wilmot et al. |
| 5,862,873 | A | 1/1999 | Matthias et al. |
| 5,887,580 | A | 3/1999 | Eyre |
| 5,897,942 | A | 4/1999 | Karner et al. |
| 5,954,147 | A | 9/1999 | Overstreet et al. |
| 5,957,228 | A | 9/1999 | Yorston et al. |
| 5,979,578 | A | 11/1999 | Packer |
| 6,009,963 | A | 1/2000 | Chaves et al. |
| 6,011,232 | A | 1/2000 | Matthias |
| 6,054,693 | A | 4/2000 | Barmatz et al. |
| 6,063,333 | A | 5/2000 | Dennis |
| 6,082,474 | A | 7/2000 | Matthias |
| 6,123,612 | A | 9/2000 | Goers |
| 6,126,741 | A | 10/2000 | Jones et al. |
| 6,131,678 | A | 10/2000 | Griffin |
| 6,145,607 | A | 11/2000 | Griffin et al. |
| 6,165,616 | A | 12/2000 | Lemelson |
| 6,193,001 | B1 | 2/2001 | Eyre et al. |
| 6,202,770 | B1 | 3/2001 | Jurewicz et al. |
| 6,202,771 | B1 | 3/2001 | Scott et al. |
| 6,227,318 | B1 | 5/2001 | Siracki |
| 6,234,261 | B1 | 5/2001 | Evans et al. |
| 6,248,447 | B1 | 6/2001 | Griffin et al. |
| 6,269,894 | B1 | 8/2001 | Griffin |
| 6,283,234 | B1 | 9/2001 | Torbet |
| 6,302,225 | B1 | 10/2001 | Yoshida et al. |
| 6,315,067 | B1 | 11/2001 | Fiedler |
| 6,315,652 | B1 | 11/2001 | Snyder et al. |
| 6,344,149 | B1 | 2/2002 | Oles |
| 6,410,085 | B1 | 6/2002 | Griffin et al. |
| 6,435,058 | B1 | 8/2002 | Matthias et al. |
| 6,443,248 | B2 | 9/2002 | Yong et al. |
| 6,488,106 | B1 | 12/2002 | Dourfaye |
| 6,510,910 | B2 | 1/2003 | Eyre et al. |
| 6,527,069 | B1 | 3/2003 | Meiners et al. |
| 6,544,308 | B2 | 4/2003 | Griffin et al. |
| 6,550,556 | B2 | 4/2003 | Middlemiss et al. |
| 6,562,462 | B2 | 5/2003 | Griffin et al. |
| 6,571,891 | B1 | 6/2003 | Smith et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,662 | B2 | 8/2003 | Matthias et al. |
| 6,739,214 | B2 | 5/2004 | Griffin et al. |
| 6,739,417 | B2 | 5/2004 | Smith et al. |
| 6,749,033 | B2 | 6/2004 | Griffin et al. |
| 6,797,326 | B2 | 9/2004 | Griffin et al. |
| 6,892,836 | B1 | 5/2005 | Eyre |
| 7,234,550 | B2 | 6/2007 | Azar et al. |
| 7,261,753 | B2 | 8/2007 | Yamamoto et al. |
| 7,377,341 | B2 | 5/2008 | Middlemiss et al. |
| 7,426,969 | B2 | 9/2008 | Azar |
| 7,462,003 | B2 | 12/2008 | Middlemiss |
| 7,473,287 | B2 | 1/2009 | Belnap et al. |
| 7,517,589 | B2 | 4/2009 | Eyre |
| 7,533,740 | B2 | 5/2009 | Zhang et al. |
| 7,647,993 | B2 | 1/2010 | Middlemiss |
| 2002/0023733 | A1 | 2/2002 | Hall |
| 2005/0050801 | A1 | 3/2005 | Cho |
| 2005/0115744 | A1 | 6/2005 | Griffin et al. |
| 2005/0129950 | A1 | 6/2005 | Griffin et al. |
| 2005/0139397 | A1 | 6/2005 | Achilles |
| 2005/0230156 | A1 | 10/2005 | Belnap et al. |
| 2005/0263328 | A1 | 12/2005 | Middlemiss |

| | | | | |
|---|---|---|---|---|
| 2005/0269139 | A1 | 12/2005 | Shen et al. | |
| 2006/0032677 | A1 | 2/2006 | Azar et al. | |
| 2006/0060390 | A1 | 3/2006 | Eyre | |
| 2006/0060392 | A1 | 3/2006 | Eyre et al. | |
| 2006/0165993 | A1 | 7/2006 | Keshavan | |
| 2006/0217258 | A1 | 9/2006 | Zhao | |
| 2006/0266558 | A1 | 11/2006 | Middlemiss et al. | |
| 2007/0079994 | A1 | 4/2007 | Middlemiss | |
| 2007/0169419 | A1 | 7/2007 | Davis et al. | |
| 2007/0181348 | A1 | 8/2007 | Lancaster et al. | |
| 2008/0142276 | A1 | 6/2008 | Griffo | |
| 2008/0209818 | A1* | 9/2008 | Belnap et al. | 51/307 |
| 2008/0223621 | A1* | 9/2008 | Middlemiss et al. | 175/428 |
| 2008/0223623 | A1 | 9/2008 | Keshavan | |
| 2008/0230280 | A1 | 9/2008 | Keshavan et al. | |
| 2009/0133938 | A1 | 5/2009 | Hall et al. | |
| 2009/0173547 | A1* | 7/2009 | Voronin et al. | 175/375 |
| 2010/0122852 | A1* | 5/2010 | Russell et al. | 175/428 |

FOREIGN PATENT DOCUMENTS

| | | |
|---|---|---|
| EP | 0156264 | 10/1985 |
| EP | 0157278 | 10/1985 |
| EP | 0 196 777 | 10/1986 |
| EP | 0246789 | 11/1987 |
| EP | 0 297 071 | 12/1988 |
| EP | 0300699 | 1/1989 |
| EP | 0329954 | 8/1989 |
| EP | 0336698 | 10/1989 |
| EP | 0 352 811 | 1/1990 |
| EP | 0 374 424 | 6/1990 |
| EP | 0500253 | 8/1992 |
| EP | 0 582 484 | 2/1994 |
| EP | 0595630 | 5/1994 |
| EP | 0612868 | 8/1994 |
| EP | 0617207 | 9/1994 |
| EP | 0787820 | 8/1997 |
| EP | 0860515 | 8/1998 |
| EP | 1116858 | 7/2001 |
| EP | 1190791 | 3/2002 |
| EP | 1958688 | 8/2008 |
| GB | 1349385 | 4/1974 |
| GB | 2048927 | 12/1980 |
| GB | 2204625 | 11/1988 |
| GB | 2 261 894 | 6/1993 |
| GB | 2268768 | 1/1994 |
| GB | 2270492 | 3/1994 |
| GB | 2270493 | 3/1994 |
| GB | 2323398 | 9/1998 |
| GB | 2351747 | 1/2001 |
| GB | 2367081 | 3/2002 |
| GB | 2408735 | 6/2005 |
| GB | 2409474 | 6/2005 |
| GB | 2413575 | 11/2005 |
| GB | 2418215 | 3/2006 |
| GB | 2422623 | 8/2006 |
| GB | 2427215 | 12/2006 |
| GB | 2429471 | 2/2007 |
| GB | 2429727 | 3/2007 |
| GB | 2 431 948 | 5/2007 |
| GB | 2438073 | 11/2007 |
| GB | 2447776 | 9/2008 |
| GB | 2 413 813 | 11/2008 |
| GB | 2 438 319 B | 3/2009 |
| GB | 2 453 023 | 3/2009 |
| GB | 2 429 471 B | 7/2009 |
| GB | 2 454 122 B | 7/2009 |
| JP | 60187603 | 10/1984 |
| JP | 59219500 | 12/1984 |
| JP | 8176696 | 7/1996 |
| SU | 990486 | 1/1983 |
| WO | 9323204 | 11/1993 |
| WO | 9634131 | 10/1996 |
| WO | 0028106 | 5/2000 |
| WO | 2004040095 | 5/2004 |
| WO | 2004106003 | 12/2004 |
| WO | 2004106004 | 12/2004 |
| WO | 2007042920 | 4/2007 |
| WO | 2008063568 | 5/2008 |
| WO | 2009125355 | 10/2009 |

OTHER PUBLICATIONS

Office Action in U.S. Patent Application No. 90/009,607 (Reexamination of Pat. No. 7,533,740), dated Jan. 27, 2010, 13 pages.

Office Action in U.S. Appl. No. 12/406,764 dated Mar. 18, 2010.

Office Action in U.S. Appl. No. 12/416,817, dated Mar. 9, 2010.

Office Action in U.S. Patent Reexamination Control No. 90/009,607, dated Apr. 1, 2010.

Radtke et al., Faster Drilling Longer Life: Thermally Stable Diamond Drill Bit Cutters, Summer 2004 Gas Tips, 2004, pp. 5-9.

Zhang et al.; "Thermally stable polycrystalline diamond cutting elements and bits incorporating the same" filed as U.S. Appl. No. 12/406,764, filed Mar. 18, 2009, which is a divisional of U.S. Appl. No. 11/350,602, now US Pat No. 7,533,740; ; total 38 pages.

Zhang et al.; "Thermally stable polycrystalline diamond cutting elements and bits incorporating the same" filed as U.S. Appl. No. 12/416,817, filed Apr. 1, 2009, which is a divisional of U.S. Appl. No. 11/350,602, now US Pat No. 7,533,740; total 38 pages.

Office Action in U.S. Appl. No. 12/406,764 dated Aug. 20, 2010.

Office Action in U.S. Appl. No. 11/350,620, now Issued patent No. 7,533,740, dated Jun. 9, 2008.

Office Action in U.S. Appl. No. 11/350,620, now Issued patent No. 7,533,740, dated Oct. 31, 2008.

Notice of Allowance in U.S. Appl. No. 11/350,620, now Issued patent No. 7,533,740, dated Feb. 10, 2009.

Office Action in U.S. Appl. No. 12/416,817, dated Jul. 31, 2009.

Reexamination application No. 90/009,607 filed Oct. 13, 2009 (Reexamination of Pat. No. 7,533,740 issued May 19, 2009).

* cited by examiner

DIAMOND BONDED CONSTRUCTION WITH THERMALLY STABLE REGION

FIELD OF THE INVENTION

This invention generally relates to diamond bonded constructions and, more particularly, to diamond bonded constructions that are specially engineered having one or more thermally stable regions disposed therein to provide improved performance properties of thermal stability and wear resistance where it is needed most in the construction while also providing desired properties of strength and fracture toughness when compared to conventional constructions comprising solely polycrystalline diamond or comprising solely thermally stable polycrystalline diamond.

BACKGROUND OF THE INVENTION

The use of constructions comprising a body formed from ultra-hard materials such as diamond, polycrystalline diamond (PCD), cubic boron nitride (cBN), polycrystalline cubic boron nitride (PcBN) are well known in the art. An example of such can be found in the form of cutting elements comprising an ultra-hard component or body that is joined to a metallic component. In such cutting element embodiment, the wear or cutting portion is formed from the ultra-hard component and the metallic portion is provided for the purpose of attaching the cutting element to a desired wear and/or cutting device. In such known constructions, the ultra-hard component can be formed from those ultra-hard materials described above that provide a high level of wear and/or abrasion resistance that is greater than that of the metallic component.

The use of PCD as an ultra-hard material for forming such constructions is well known in the art. PCD is formed by subjecting a volume of diamond grains to high pressure/high temperature (HPHT) conditions in the presence of a suitable catalyst material, such as a solvent catalyst metal selected from Group VIII of the Periodic table. Such PCD material is typically used to form the ultra-hard body that is attached to the metallic substrate. An issue that is known to exist with such conventional diamond bonded constructions comprising an ultra-hard body formed exclusively from PCD is that it is subject to thermal stresses and thermal degradation at elevated operating temperatures, due to the presence of the solvent metal catalyst, which is known to limit the effective service life of the construction when subjected to such operating temperatures.

Attempts to address such unwanted thermal performance of conventional PCD constructions have included removing the catalyst material, or solvent metal catalyst material, either partially or completely therefrom. For example, one known approach has involved removing the catalyst material completely from the PCD construction after it has been sintered, e.g., by the HPHT process noted above, by subjecting the PCD construction to a leaching process for a period of time that has resulted in the formation of a diamond bonded body that was substantially free of the catalyst material. The diamond bonded body resulting from such leaching process is referred to in the art as being thermally stable polycrystalline diamond (TSP) because the catalyst material has been removed therefrom.

While conventional TSP does have improved properties of thermal stability, abrasion and wear resistance at elevated temperatures when compared to conventional PCD, it lacks desired properties of strength, toughness, impact resistance and room-temperature hardness that were provided by the presence of the catalyst solvent metal. Thus, such conventional TSP while being well suited for some high temperature operating conditions, is not well suited for all such applications, e.g., those calling for properties of impact resistance, strength and/or toughness. Further, conventional TSP does not lend itself to attachment with a metallic substrate by HPHT process, and either has to be attached to a metallic substrate or directly to the end use application device by braze process. The need to attach the TSP body in this manner to a metallic substrate or to the end use device presents a further failure mechanism during operation due to the different material properties of the TSP body and substrate, and the related inability to form a strong attachment joint therebetween, which shortcomings operate to reduce the effective service life of cutting elements formed therefrom.

Another known approach aimed at improving the thermal stability of conventional PCD constructions involves removing the catalyst material from only a selected region of the PCD body, and not from the entire PCD body. Such removal of the catalyst material from only a region of the PCD body is achieved by subjecting the targeted region of the PCD body to a leaching agent for a period of time to provide a desired depth of catalyst material removal, and thereby leaving the catalyst material in a remaining region of the PCD body. This approach results in improving the thermal stability of the PCD construction at the treated region, while allowing the metallic substrate to remain attached to the construction. While this approach did improve the thermal stability of the PCD construction, and did provide a PCD construction having a strong substrate attachment, it is believed that further improvements in optimizing the desired performance properties of thermal stability, abrasion and wear resistance, strength, impact resistance, and toughness can be achieved.

It is, therefore, desired that a diamond bonded construction be provided in a manner that provides a desired optimized combination of thermal stability, wear and abrasion resistance, strength, impact resistance, and toughness when compared to conventional PCD, conventional TSP, or to the past attempts described above. It is further desired that such diamond bonded construction be produced in a manner that is efficient and does not involve the use of exotic materials and/or techniques.

SUMMARY OF THE INVENTION

Diamond bonded constructions, prepared according to principles of the invention, comprise a sintered polycrystalline diamond body having a matrix phase of bonded-together diamond grains and a plurality of interstitial regions disposed between the diamond grains, wherein the catalyst material used to form the diamond body is disposed within the interstitial regions. The construction includes one or more thermally stable diamond elements or segments disposed within the diamond body, wherein the thermally stable diamond element is positioned within the body to form at least part of a construction working surface. The thermally stable diamond element is bonded to the polycrystalline diamond body, and the construction includes a substrate bonded to the polycrystalline diamond body.

In an example embodiment, the thermally stable diamond element comprises at least 5 percent of the construction working surface, wherein the working surface is a surface of the construction that engages or could engage a formation or other type of object being cut or worn by contact with the construction. The thermally stable diamond element comprises a plurality of bonded-together diamond grains and interstitial regions, wherein the interstitial regions are substantially free of a catalyst material used to make or sinter the thermally stable diamond element. In an example embodiment, the thermally stable diamond element comprises a first diamond region adjacent a top surface and a second diamond region adjacent a bottom surface, wherein the first and second diamond regions are formed from differently sized diamond grains. The first and second diamond regions may also or alternatively comprise different diamond volume contents.

The thermally stable diamond element may include a barrier material disposed over one or more of its surfaces and/or may include an infiltrant material disposed therein to control, minimize and/or eliminate infiltration of the catalyst material used to form the polycrystalline diamond body therein. In an example embodiment, the thermally stable element may include one surface that does not include the barrier material or that is not filled with an infiltrant to facilitate the infiltration of the catalyst material used to form the polycrystalline diamond body therein to provide a desired attachment with the body. The infiltrant can be introduced into the thermally stable diamond element before or during an HPHT process used to form the polycrystalline diamond body.

Diamond bonded constructions can be made by forming a thermally stable diamond element from a polycrystalline diamond material, the polycrystalline diamond material comprising a plurality of bonded-together diamond grains with a catalyst material disposed within interstitial regions between the diamond gains, wherein the method of forming comprises removing the catalyst from the interstitial regions. One or more of the thermally stable diamond elements are combined with a volume of diamond grains to form an assembly, and the assembly is subjected to HPHT conditions to sinter the volume of diamond grains to form a polycrystalline diamond body. The thermally stable diamond element is disposed within and bonded to the polycrystalline diamond body and forms a surface of the diamond bonded construction. As noted above, the thermally stable diamond element can includes a barrier material in the form of a material layer or infiltrant to control, minimize and/or eliminate infiltration of the catalyst material used to form or sinter the polycrystalline diamond body. The barrier and/or infiltrant material may also be selected to provide an improved bond strength between the TSP element and the PCD body and/or to provide one or more improved properties such as fracture toughness, impact strength, and thermal conductivity to the TSP element.

Diamond bonded constructions, prepared according to principles of the invention, have properties of improved wear and/or abrasion resistance at the wear or cutting surface provided by placement of the thermally stable diamond element at such surface, while retaining desired properties of strength and toughness as provided by the polycrystalline diamond body. The construction structure of a composite, comprising the use of one or more thermally stable diamond elements to provide at least a portion of the working surface, and polycrystalline diamond to form the remaining diamond body, provides combined properties of wear and abrasion resistance, impact resistance, toughness, and strength not otherwise possible in a conventional homogeneous polycrystalline diamond construction or a conventional homogeneous thermally stable polycrystalline diamond construction.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
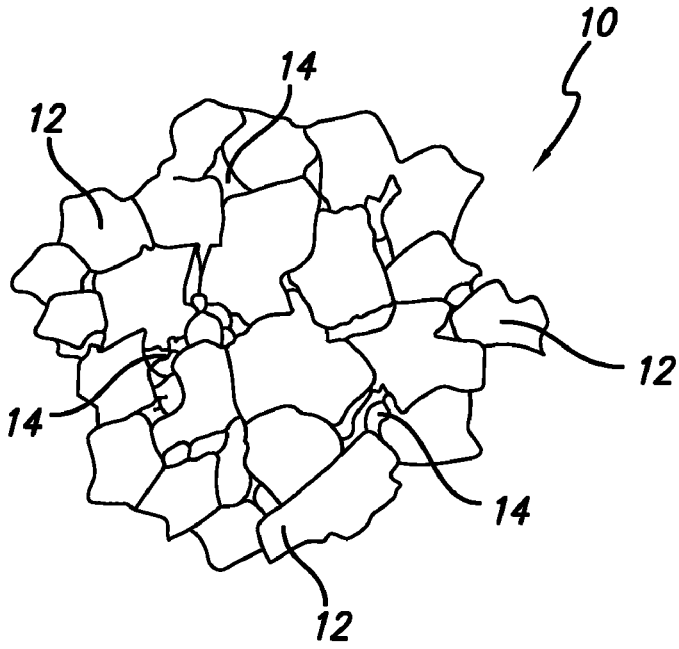
FIG. 1 is a view taken from a section of a diamond bonded element or segment after it has been treated to remove a catalyst material used to form the same therefrom.

Diamond bonded constructions of this invention comprise a diamond bonded body including one or more thermally stable polycrystalline diamond (TSP) elements or segments that are disposed therein. The diamond bonded body is formed from polycrystalline diamond (PCD) and the one or more TSP segments are joined or attached thereto during formation of the diamond bonded body at high pressure/high temperature (HPHT) conditions. The one or more TSP segments can be provided in a number of different predetermined shapes and sizes depending on the particular end-use application, and the segments may optionally be partially or fully coated and/or covered and/or backfilled with a desired material that can be the same or different as the catalyst material used to sinter the PCD portion of the diamond bonded body. The diamond bonded constructions further include a metallic substrate joined or otherwise attached to the diamond bonded body to facilitate attachment of the constriction to a desired end-use device.

While the body has been described above as a diamond bonded body, it is to be understood that the body can be formed from ultra-hard materials other than diamond. As used herein, the term "ultra-hard" is understood to refer to those materials known in the art to have a grain hardness of about 4,000 HV or greater. Such ultra-hard materials can include those capable of demonstrating physical stability at temperatures above about 750° C., and for certain applications above about 1,000° C., that are formed from consolidated materials. Such ultra-hard materials can include but are not limited to diamond, PCD, cubic boron nitride (cBN), polycrystalline cBN (PcBN) diamond-like carbon, boron suboxide, aluminum manganese boride, and other materials in the boron-nitrogen-carbon phase diagram which have shown hardness values similar to cBN and other ceramic materials.

Polycrystalline diamond (PCD) is an ultra-hard material that is formed in the manner noted above by subjecting a volume of diamond grains to HPHT conditions in the presence of a catalyst material. The catalyst material can be a solvent catalyst metal, such as one or more selected from Group VIII of the Periodic table. As used herein, the term "catalyst material" refers to the material that was initially used to facilitate diamond-to-diamond bonding or sintering during the initial HPHT process used to form the PCD.

Thermally stable polycrystalline diamond (TSP) is formed by removing the catalyst material from PCD, so that the remaining diamond structure is substantially free of the catalyst material. TSP has a material microstructure characterized by a polycrystalline phase comprising bonded-together diamond grains or crystals and a plurality of voids or empty pores that exist within interstitially regions disposed between the bonded together diamond grains. A feature of diamond bonded constructions of this invention is that they include one or more TSP elements, regions or segments that are disposed within a PCD region or body, and that are incorporated in the body when the remaining portion of the diamond bonded body is being sintered.

As used herein, the terms "element", "region" or "segment" as used to characterize the TSP portion are understood to refer to a continuous portion of the construction having the same material microstructure that is different from a surrounding portion of the construction, and that is sized and/or shaped to (initially or during use) to form at least a portion of a working surface of the construction. The element, region or segment can be sized, shaped and/or placed within the construction such that it provides a construction working surface prior to operation, or can be configured to not initially be an outer or working surface but later become an outer or working surface during operation, e.g., when placed into a wear and/or cutting operation for some amount of time. Alternatively, the TSP region or segment may provide an outer or working surface of the construction after a machining or grinding process is performed on the construction prior to or after placement of the construction into operation.

Diamond grains useful for forming the TSP and/or PCD regions of the construction can include natural and/or synthetic diamond powders having an average diameter grain size in the range of from submicrometer in size to 100 micrometers, and more preferably in the range of from about 1 to 80 micrometers. The diamond powder can contain grains having a mono or multi-modal size distribution. In an example embodiment, the diamond powder has an average particle grain size of approximately 20 micrometers. In the event that diamond powders are used having differently sized grains, the diamond grains are mixed together by conventional process, such as by ball or attritor milling for as much time as necessary to ensure good uniform distribution.

The diamond grain powder is preferably cleaned, to enhance the sinterability of the powder by treatment at high temperature, in a vacuum or reducing atmosphere. The diamond powder mixture is loaded into a desired container for placement within a suitable HPHT consolidation and sintering device.

The diamond powder may be combined with a desired catalyst material, e.g., a solvent metal catalyst, in the form of a powder to facilitate diamond bonding during the HPHT process and/or the catalyst material can be provided by infiltration from a substrate positioned adjacent the diamond powder and that includes the catalyst material. Suitable substrates useful as a source for infiltrating the catalyst material can include those used to form conventional PCD materials, and can be provided in powder, green state and/or already-sintered form. A feature of such substrate is that it includes a metal solvent catalyst as one of its material constituents that is capable of melting and infiltrating into the adjacent volume of diamond powder to facilitate bonding the diamond grains together during the HPHT process. In an example embodiment, the catalyst material is cobalt, and a substrate useful for providing the same is a cobalt containing substrate, such as WC—Co.

Alternatively, the diamond powder mixture can be provided in the form of a green-state part or mixture comprising diamond powder that is combined with a binding agent to provide a conformable material product, e.g., in the form of diamond tape or other formable/conformable diamond mixture product to facilitate the manufacturing process. In the event that the diamond powder is provided in the form of such a green-state part, it is desirable that a preheating step take place before HPHT consolidation and sintering to drive off the binder material. In an example embodiment, the PCD material resulting from the above-described HPHT process may have a diamond volume content in the range of from about 85 to 95 percent.

The diamond powder mixture or green-state part is loaded into a desired container for placement within a suitable HPHT consolidation and sintering device. The HPHT device is activated to subject the container to a desired HPHT condition to effect consolidation and sintering of the diamond powder. In an example embodiment, the device is controlled so that the container is subjected to a HPHT process having a pressure of 5,000 MPa or greater and a temperature of from about 1,300° C. to 1,500° C. for a predetermined period of time. At this pressure and temperature, the catalyst material melts and infiltrates into the diamond powder mixture, thereby sintering the diamond grains to form PCD. After the HPHT process is completed, the container is removed from the HPHT device, and the so-formed PCD part is removed from the container.

The PCD part can be configured having a desired size and/or shape for eventual use within the diamond bonded body, after treatment to remove the catalyst material therefrom, without any further shaping or sizing. Alternatively, the PCD part can initially be configured having a form that facilitates HPHT processing, and that is subsequently shaped and/or sized as desired for use in forming the diamond bonded body. For example, the PCD part can be made in the form of a single part that is shaped and/or cut into the desired elements, segments or regions for use in the diamond body by conventional process, such as EDM or laser cutting technique.

In the event that a substrate is used during the HPHT process, e.g., as a source of the catalyst material, the substrate is preferably removed prior to a subsequent step of treating the PCD part to remove the catalyst material therefrom to form the desired TSP part. Alternatively, the substrate can be removed during or after the treatment to form TSP. In a preferred embodiment, any infiltration substrate is removed prior to treatment to expedite the process of removing the catalyst material from the PCD part to form the desired TSP.

The term "removed", as used with reference to the catalyst material after the treatment process for forming the desired TSP part, is understood to mean that a substantial portion of the catalyst material no longer resides within the part. However, it is to be understood that some small amount of catalyst material may still remain in the part, e.g., within the interstitial regions and/or adhered to the surface of the diamond crystals. Additionally, the term "substantially free", as used herein to refer to the catalyst material in the part after the treatment process, is understood to mean that there may still be some small/trace amount of catalyst material remaining within the TSP part as noted above.

In an example embodiment, the PCD part is treated to render it substantially free of the catalyst material. This can be done, by subjecting the PCD part to chemical treatment such as by acid leaching or aqua regia bath, electrochemical treatment such as by electrolytic process, by liquid metal solubility, or by liquid metal infiltration that sweeps the existing catalyst material away and replaces it with another noncatalyst material during a liquid phase sintering process, or by combinations thereof. In an example embodiment, the catalyst material is removed from the PCD part by an acid leaching technique, such as that disclosed for example in U.S. Pat. No. 4,224,380. Additionally, the PCD part can be subjected to such treatment before or after any desired reshaping or resizing operation.

FIG. 1 illustrates a section taken from a TSP part 10 formed by removing the catalyst material therefrom in the manner described above. The TSP part 10 has a material microstructure comprising a polycrystalline diamond matrix phase made up of a plurality of diamond grains or crystals 12 that are bonded together, and a plurality of interstitial regions 14 that are disposed between the bonded-together diamond grains, and that exist as empty pores or voids within the matrix phase of the material microstructure, as a result of the catalyst material being removed therefrom.

Figure 2:
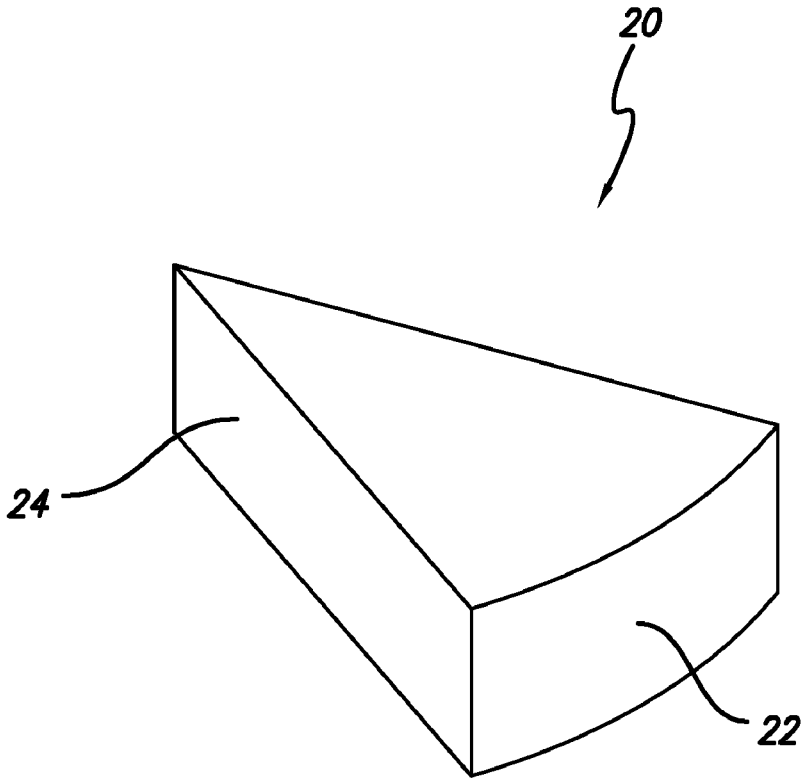
FIG. 2 is a perspective view of an example diamond bonded segment after it has been treated to remove the catalyst material used to form the same therefrom.

FIG. 2 illustrates an example embodiment of a TSP part 20 useful for being included within a diamond bonded body. As noted above, it is to be understood that the TSP part 20 can be formed from a sintered PCD part without subsequent shaping and/or sizing, or can be formed from a PCD part that has been reshaped and/or resized as desired for a particular end-use application. In an example embodiment, the TSP part 20 illustrated in FIG. 2 is initially provided in the form of a PCD wafer or disk that is subsequently leached to remove the catalyst material, and that is reshaped and/or resized into the desired predetermined configuration useful as the TSP element, region or segment, wherein the sequence of leaching and reshaping and/or resized can be switched.

In this particular embodiment, the PCD part was reshaped in the form of a number of different wedge-shaped TSP parts or segments. The wedge or pie-shaped segment has a generally convex outer surface 22 with radially inwardly extending side surfaces 24. The outer surface 22 can be configured having a radius of curvature that is the same, similar or that corresponds to the radius of curvature of the final diamond bonded body for placement of the TSP segment outer surface 22 along or adjacent an outermost edge of the construction, e.g., along a peripheral edge of the construction. The TSP part 20, for this and other embodiments, can have an axial thickness or depth that will vary depending on such factors as the particular size and shape of the TSP part, the particular construction configuration and/or the particular end use application and/or manufacturing constraints.

In an example embodiment, it is desired that the TSP part have a thickness that will promote HPHT formation of the TSP part without cracking or fracture, and that will promote subsequent incorporation of the TSP part into and formation of the diamond body in a subsequent HPHT process, e.g., avoiding cracking or fracture in such subsequent HPHT process. In an example embodiment, the TSP part may have a thickness of about 2 mm, as this thickness has been found to provide a desired degree of robustness to the TSP part, thereby helping to avoid unwanted crack or fracture formation during HPHT formation of the diamond body.

Configured in this manner, one or more TSP segments can be positioned within the diamond construction along an outermost surface of the construction, e.g., being positioned along a working surface and or cutting edge of the construction. Additionally, the segment shape of the TSP part helps to both minimize internal stresses within the constriction and provide a high level of strength to the construction.

While FIG. 2 illustrates a TSP part or segment having a particular configuration, it is to be understood that TSP parts as used in conjunction with diamond bonded constructions of this invention can be configured differently than as illustrated in FIG. 2 depending on a number of factors such as the end-use application, the particular placement of the construction working surface, and the choice of materials used to form the TSP part and/or the diamond bonded body. In an example embodiment, it is desired that the TSP part be configured in a manner that assists in minimizing internal stress within the construction, provides a desired improvement in wear resistance, abrasion resistance, and/or thermal resistance to the diamond bonded construction, while at the same time retaining the desired high strength properties of the remaining portion of the diamond bonded body. In a preferred embodiment, the TSP part is configured to facilitate its placement and/or use at or adjacent a working surface or cutting edge of the diamond bonded construction, wherein the working surface of the construction can be any surface of the construction that is placed into contact with material being cut and/or removed when used in a cutting and/or wear application.

Figure 13:
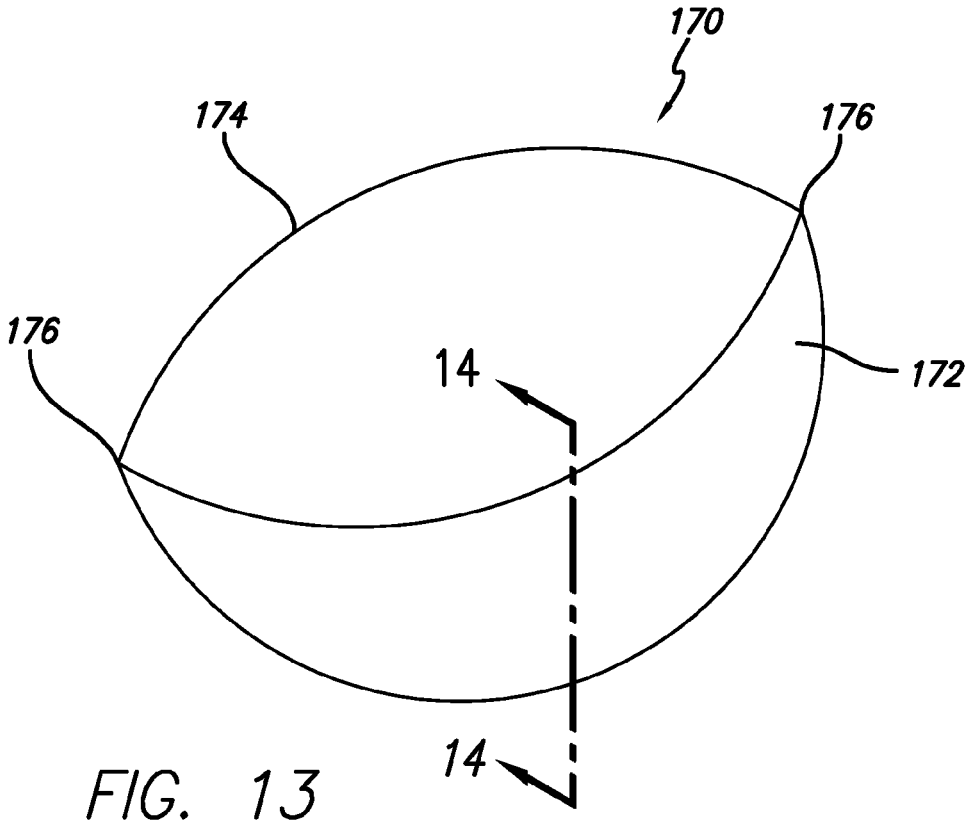
FIG. 13 is a perspective view an example embodiment TSP part useful for forming diamond bonded constructions.
Figure 14:
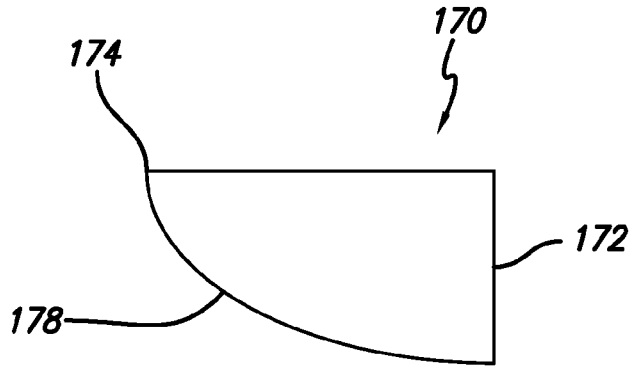
FIG. 14 is a sectional view of the TSP part taken from FIG. 13.

FIGS. 13 to 16 illustrate additional embodiments of TSP parts useful for forming diamond bonded constructions of the invention. FIG. 13 illustrates a TSP part 170 that is provided in the form of a segment having a generally convex outer surface 172 with a radius of curvature that is the same as that of the diamond body for placement along a working edge of the diamond bonded construction. The TSP part 170 includes a radiused inner surface 174 that extends inwardly from side edges 176 of the TSP part. The outer surface 172 has a desired axial thickness as noted above, and is sized to extend along a desired portion of the diamond body circumference positioned along the construction working surface. Referring now to FIG. 14, the TSP part of this embodiment is shown to have an axial thickness that changes moving from the outer surface 172 to the inner surface 174. Specifically, the TSP part has a bottom surface 178 that is curved and that slopes upwardly moving from the outer surface 172 to the inner surface 174, i.e., the TSP part thickness in this embodiment decreases with position moving away from the outer surface 172 to the inner surface 174. In this particular embodiment, all of the TSP part surfaces that interface with the diamond body are curved or rounded for the purposes of helping to reduce unwanted stress in the diamond body. While the TSP part embodiment illustrated in FIGS. 13 and 14 have diamond body interface surfaces that are all rounded, it is to be understood that other TSP part embodiments such as those configured having one or more rounded interface surfaces, are intended to be within the scope of this invention, e.g., the bottom surface may be rounded while the inside surface may not be and visa versa.

Figure 15:
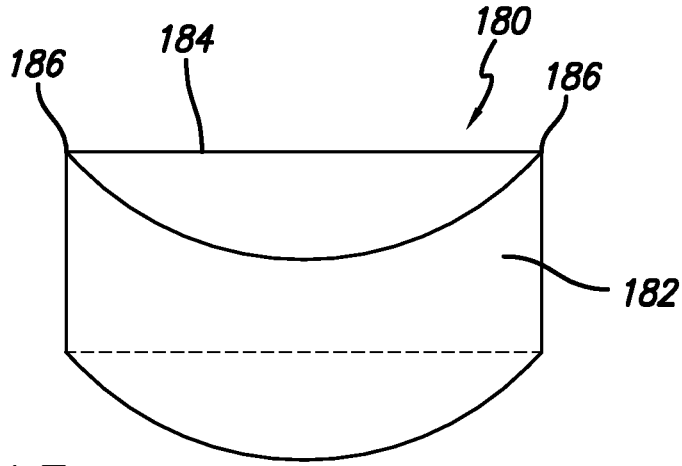
FIG. 15 is a perspective view of another example embodiment TSP part useful for forming diamond bonded constructions.

FIG. 15 illustrates another embodiment TSP part 180 that is provided in the form of a segment having a generally convex outer surface 182 with a radius of curvature that is the same as that of the diamond body for placement along a working edge of the diamond bonded construction. The TSP part 180 includes an inner surface 184 that is generally planar and that extends from side edges 186 of the TSP part. The outer surface 172 has a desired axial thickness as noted above, and is sized to extend along a desired portion of the diamond body circumference positioned along the construction working surface. The TSP part 180 of this embodiment has an axial thickness that is constant moving from the outer surface 182 to the inner surface 184. In this particular embodiment, the TSP part has a radial thickness measured between the inner and outer surfaces that increases moving away from the edges 186 to a center portion of the TSP part.

Figure 16:
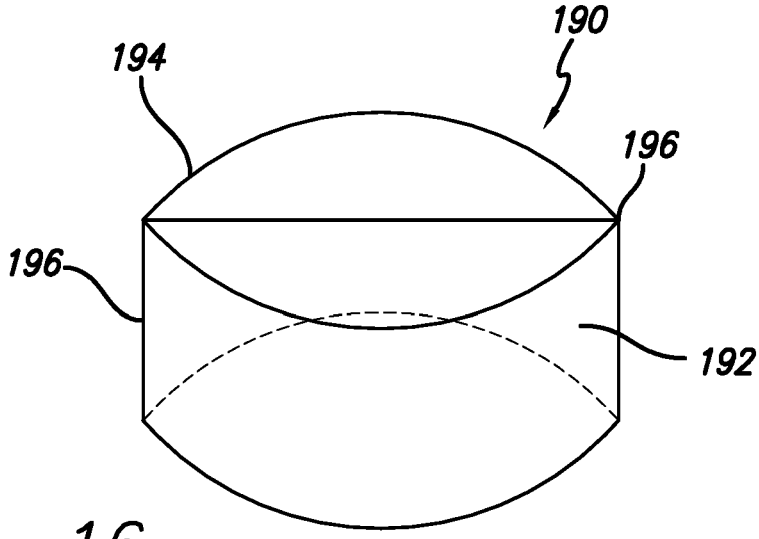
FIG. 16 is a perspective view of another example embodiment TSP part useful for forming diamond bonded constructions.

FIG. 16 illustrates another embodiment TSP part 190 that is provided in the form of a segment having a generally convex outer surface 192 with a radius of curvature that is the same as that of the diamond body for placement along a working edge of the diamond bonded construction. The TSP part 190 includes an inner surface 194 that, like the embodiment illustrated in FIG. 13, is radiused to extend outwardly from the outer surface 192 and that extends from side edges 196 of the TSP part. The outer surface 192 has a desired axial thickness as noted above, and is sized to extend along a desired portion of the diamond body circumference positioned along the construction working surface. The TSP part 190 of this embodiment, like that illustrated in FIG. 15, has an axial thickness that is constant moving from the outer surface 192 to the inner surface 194. In this particular embodiment, the TSP part has a radial thickness measured between the inner and outer surfaces that increases moving away from the edges 196 to a center portion of the TSP part. In an example embodiment, the TSP segment has a shape of two intersecting and opposed cylindrical surfaces. A TSP part shaped in this manner helps to reduce thermal mismatch stresses in both the TSP part and diamond body, thereby decreasing the probability of crack formation in each during HPHT processing, and during stages of bonding, brazing and operation of the end-use device.

Figure 17:
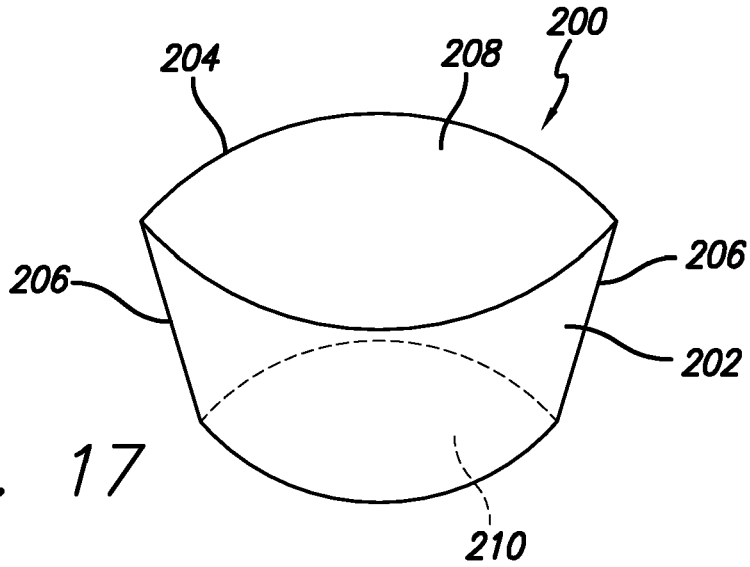
FIG. 17 is a perspective view of another example embodiment TSP part useful for forming diamond bonded constructions.

FIG. 17 illustrates another embodiment TSP part 200 that is provided in the form of a segment having a generally convex outer surface 202 with a radius of curvature that is the same as that of the diamond body for placement along a working edge of the diamond bonded construction. The TSP part 200 includes an inner surface 204 that, like the embodiment illustrated in FIG. 13, is radiused to extend outwardly from the outer surface 202 and that extends from side edges 206 of the TSP part. The TSP part 200 has a desired axial thickness as noted above, and is sized to extend along a desired portion of the diamond body circumference positioned along the construction working surface. The TSP part 200 of this embodiment, like that illustrated in FIG. 15, has an axial thickness that is constant moving from the outer surface 202 to the inner surface 204. Unlike the TSP part embodiment illustrated in FIG. 16 having top and bottom surfaces with generally the same surface areas, the TSP part of this embodiment has a top surface 208 that is sized differently than that of a bottom surface 210. The top surface can be larger or smaller than the bottom surface, and in the example embodiment illustrated in FIG. 17 is sized larger than the bottom surface. In an example embodiment, the TSP segment has a shape of two intersecting and opposed cylindrical surfaces, wherein one or both of the surfaces forming the outer and inner surfaces are tilted inwardly towards the other moving from the top to the bottom surface, thereby providing the desired difference in top and bottom surface area. A TSP part shaped in this manner helps to further reduce thermal mismatch stresses in both the TSP part and diamond body when compared to the embodiment illustrated in FIG. 16, thereby decreasing the probability of crack formation in each during HPHT processing, and during stages of bonding, brazing and operation of the end-use device.

If desired, the PCD material used to form the TSP part can comprise a uniform or homogeneous distribution of diamond grain sizes and diamond volume content. Alternatively, it may be desired that the PCD material used to form the TSP part be specially engineered to have different regions containing different diamond grain sizes and/or different diamond volume contents. For example, it may be desired to produce a PCD material having one region with a high diamond volume content at a position forming a working surface of the construction, and having another region with a lower diamond volume content at a position forming an attachment with the remaining diamond bonded body. In such an example embodiment, the presence of the relatively higher diamond volume content operates to provide improved properties of wear and abrasion resistance at the working surface while also operating to resist material infiltration from the remaining diamond bonded body.

In another example, the TSP part region forming the working surface can comprise diamond grains having a relatively finer grain size than that of the diamond grains used in the TSP part region forming an attachment with the diamond bonded body. The presence of the relatively coarser sized diamond grains in the attachment region of the TSP part can operate to facilitate infiltration of a material from the remaining diamond bonded body to assist with providing a desired strong attachment therebetween. The use of relatively finer-sized diamond grains at the working surface region also operates to resist infiltration from the remaining TSP region and the remaining diamond bonded body.

It is to be understood that the presence of such regions within the PCD material and resulting TSP part can be provided in the form of a step change such that the difference in one or more characteristics within the regions change at an interface therebetween, or can be provided in the form of a gradient change such that the difference in the one or more characteristic within the regions change gradually.

The one or more TSP parts or segments can be taken and combined with the volume of diamond material used to form the remaining diamond bonded body, and the combination of the TSP parts and the diamond volume can be subjected to an HPHT process suitable for sintering the diamond volume to form a polycrystalline diamond bonded body. During such process, a catalyst material provided with the diamond volume or provided from a substrate that is combined with the diamond volume and TSP part combination infiltrates into the diamond volume to effect sintering and infiltrates into at least an adjacent region of the TSP part to effect attachment during HPHT processing.

In an example embodiment, it is desired that the HPHT process used for sintering the diamond bonded body and forming a desired attachment with the TSP parts be controlled in a manner so that the catalyst material infiltrates the TSP part only partially so the surface layer or working surface remains substantially free of the catalyst material a desired depth from the surface. In an example embodiment, this depth can be from about 0.01 mm to about 2.5 mm or about 95 to 99 percent of the TSP part axial thickness. In an example embodiment, the depth can be in the range of from about 0.03 mm to 0.8 mm Alternatively, the TSP parts or segments can be further treated before being combined with the further material, such as diamond powder, used to form the remaining portion of the diamond bonded construction. For example, before the TSP part or parts are combined with diamond powder and the combination is subjected to HPHT conditions, to sinter the diamond powder forming the PCD body and attach the TSP parts, it may be desired to treat the TSP parts in a manner that minimizes or eliminates infiltration of the catalyst material used to form the PCD body into the TSP parts.

Figure 3A:
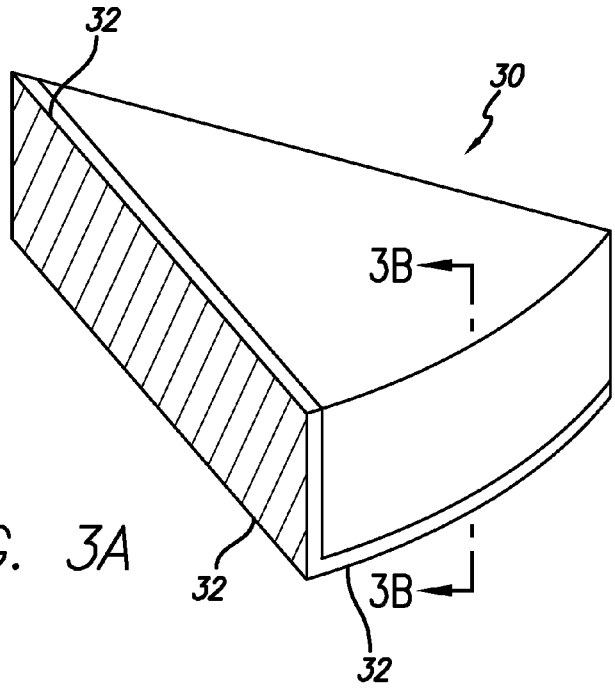
FIGS. 3A and 3C are schematic views.
Figure 3B:
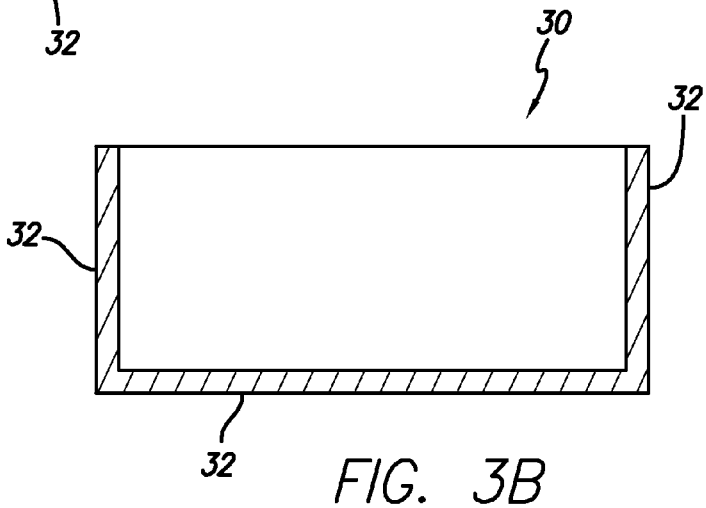
FIG. 3B is a section view, of example diamond bonded segments of FIG. 2 that have been coated or backfilled respectively.
Figure 3C:
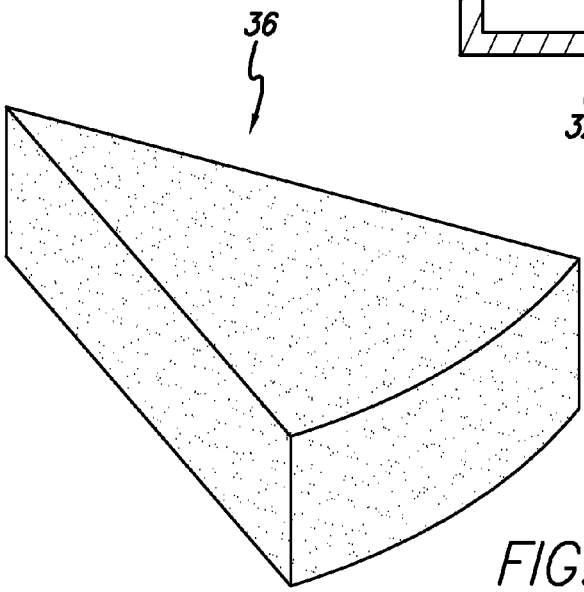

FIGS. 3A, 3B and 3C illustrate embodiments of TSP parts that have been optionally treated to control, minimize, or eliminate the infiltration of a catalyst material used to form the remaining PCD body making up the diamond bonded construction during the HPHT sintering process, and/or to introduce additional desired properties into the TSP part. FIG. 3A illustrates a TSP part 30 that comprises a material layer 32 along one or more of its outer surfaces positioned adjacent the diamond powder. FIG. 3B is a section taken from FIG. 3A that illustrates an example placement of the material layer 32 on the TSP part 30. In an example embodiment, the material layer is formed from materials that operate to control, minimize or eliminate infiltration of the catalyst material into the TSP body. Additionally, the material layer can be formed from a material that operates to provide a desired attachment bond with an adjacent surface of the PCD body during HPHT processing. In an example embodiment, those TSP surfaces exposed and otherwise placed into contact with the diamond powder comprise the material layer. Accordingly, it is to be understood that some or all of the TSP part outer surfaces may include such material layer depending on the TSP part placement position within the diamond volume forming the diamond bonded body.

The material layer can be provided in the form of a coating of the desired material that is spray, dipped or otherwise applied to a desired surface of the TSP part. The material layer can be provided in the form of a preformed film that is positioned over the desired surface of the TSP part.

Materials useful for forming the material layer can include those that have a melting temperature above that of the catalyst material used to form the host PCD body to thereby remain in solid form to control, minimize, or eliminate unwanted infiltration of the catalyst material during HPHT processing used to form the PCD body. Alternatively, materials having a melting temperature below that of the catalyst material may also be useful to form the material layer, e.g., such as carbide formers that are capable of forming a reaction product upon heating with the TSP. The material layer can cover one or more desired surface portion of the TSP body, and can extend inwardly a partial depth into the TSP body from such covered surface. In an example embodiment, the material layer can extend a depth of from about 2 to 4 layers of diamond grains into the TSP part.

Materials useful for forming the material layer include metals, oxides, nitrides, borides carbides and carbide formers, and the like capable of performing in the above-described manner. Thus, the material layer may or may not form a reaction product with the TSP surface during the HPHT treatment. Alternatively, the material layer may be applied to the TSP part, and the resulting TSP part may be subjected to a heat treatment and/or a combined heat and pressure treatment, e.g., HPHT treatment, independent of the HPHT process used to form the PCD material, to provide a desired effect, e.g., to form a reaction product or the like. Particular material layers include those formed from $Al_2O_3$, $ZrO_2$, AlN, TiN, TiC, Ti(CN), $Si_3N_4$, SiC, Ti, Mo, V, Si, and the like.

Additionally, if desired, the TSP part may include a two or more material layers of different materials. The different material layers can be formed from materials specially selected to provide desired different properties, e.g., transition and/or intermediate properties, as they relate to the TSP part and the PCD body. For example, the different material layers can be engineered to provide an improved attachment bond between the TSP part and the PCD body and/or to provide a better match in physical properties of the TSP part and PCD body, such as the differences in thermal expansion or the like. In an example embodiment, the TSP part may include a first material layer formed from a material having thermal expansion properties that are closer to it than the PCD body, and a second material layer disposed on the first coating and forming an outer surface of the TSP part that can be formed from a material having a thermal expansion property that is more closely matched to the PCD body than the first material layer. Accordingly, it is to be understood that a TSP part having multiple material layers between it and the PCD body are within the scope of the invention.

FIG. 3C illustrates a TSP part 36 that has been treated so that all or a portion of the interstitial regions within the part, previously empty by virtue of removing the catalyst material therefrom, have been filled with a desired infiltrant material. In an example embodiment, the TSP part 36 is filled, backfilled or reinfiltrated with a material that operates to control, minimize and/or eliminate the infiltration of the catalyst material used to sinter the PCD body during HPHT processing.

Infiltration of the TSP part can take place separately from the HPHT process used to form the remaining diamond bonded body or can take place during the HPHT process, i.e., in situ, used to form the remaining diamond bonded body. In an example embodiment, where the TSP part is infiltrated before being combined with the diamond powder volume and subjected to HPHT conditions, the material that can be used to infiltrate the TSP part can be one having a higher melting temperature than that of the catalyst material used to sinter the diamond bonded body. Alternatively, the infiltrant material that is used may have a melting temperature that is less than that of the catalyst material used to form the diamond body, e.g., when the infiltrant material selected is one that is capable of forming a reaction product such as a carbide with the TSP part.

Further, the TSP part can be infiltrated without the use of high temperature and/or high pressure conditions. For example, the TSP part can be infiltrated with a polymeric or sol gel precursor material that may be subsequently treated to form a desired infiltrant in the TSP part either prior to or during HPHT processing, which HPHT processing can be the same as or separate from sintering the diamond bonded body.

Additionally, the material used as the infiltrant can be one that does or does not form a reaction product within the TSP body during infiltration or at another time subsequent to infiltration, e.g., during HPHT processing. Additionally, it may be desired that the infiltrant material be one that facilitates forming a desired attachment bond between the TSP part and the PCD body during HPHT process to form the PCD body and/or one that introduces desired properties such as fracture toughness, impact strength, and/or thermal conductivity to the TSP part.

Example infiltrant materials useful for backfilling the TSP part can include the same materials noted above useful for forming the TSP material layer, such as metallic materials, carbide formers, metal carbonates, and the like. In an example embodiment, the TSP part can be infiltrated independently of the HPHT process used for sintering the PCD body. The TSP part can be infiltrated by liquid method, wherein a desired infiltrant material is swept into the TSP part at temperatures lower that the diamond body HPHT sintering temperature, and when later subjected to the PCD sintering HPHT conditions operates to control, minimize and/or prevent the infiltration of the catalyst material. For example, the infiltrant material can include a carbide former that is introduced into the TSP part independent of the PCD sintering HPHT process, and during the infiltration stage and/or HPHT process reacts with the carbon in the TSP part to form a carbide that resists catalyst material infiltration. This reaction may also increase the melting temperature of the resulting reaction product. For example, while silicon has a melting temperature that is less than cobalt, when used as an infiltrant it reacts with the TCP part during the HPHT process to form SiC that has a melting temperature above cobalt and that operates to impair cobalt infiltration into the TSP part.

It is to be understood that the material selected to form the infiltrant material may permit some degree of catalyst material infiltration therein, possibly sufficient degree to form a desired attachment bond between the TSP body and the PCD body during the PCD sintering HPHT process. However, in an example embodiment, complete infiltration of the catalyst material used to sinter the PCD body is preferably avoided. In the event that an unwanted infiltrant be present at the surface of the TSP part, a clean up treatment may be performed on the diamond bonded construction, wherein a targeted region of the construction including the a surface of the TSP part is subjected to a leaching or other process aimed at removing the infiltrant or catalyst material from a desired surface region of the TSP part and/or diamond body.

Useful infiltrant materials include metals, metal alloys, and carbide formers, i.e., materials useful for forming a carbide reaction product with the diamond in the TSP body. Example metals and metal alloys include those selected from Group VIII of the Periodic table, examples of carbide formers include those comprising Si, Ti, B, and others known to produce a carbide reaction product when combined with diamond at HPHT conditions. Useful infiltrant materials can also include materials that operate to increase the thermal transfer capability of the construction. For example, certain metals, metal alloys, combinations of metals or alloys with diamond, can be used as infiltrant materials that operate to fill the empty voids in the TSP part, thereby facilitating thermal transfer within the construction from convection to conduction.

As used herein, the term "infiltrant material" is understood to refer to materials that are other than the catalyst material used to initially form the diamond body, and can include materials identified in Group VIII of the Periodic table that have subsequently been introduced into the already formed diamond body. Additionally, the term "infiltrant material" is not intended to be limiting on the particular method or technique use to introduce such material into the already formed diamond body For the embodiment where the infiltrant material is introduced separately from the HPHT process used for forming the diamond bonded body, the infiltrant material preferably has a melting temperature that is within the diamond stable HPHT window, and that is either below or above that of the catalyst material used to sinter the PCD body. The infiltrant material can be provided in the form of a powder layer, a green state part, an already sintered parts or a preformed film. In an embodiment, the infiltrant material is provided in the form of a powder layer or a foil.

In another embodiment, the TSP part or segment can be infiltrated during the HPHT process used for sintering the diamond bonded body. In such embodiment, the infiltrant material can be selected from those materials having a melting point that is below the melting point of the catalyst material used to form the PCD body. Alternatively, the infiltrant material may have a higher melting temperature as noted above. The infiltrant material can be provided in the form of a powder or foil that is positioned adjacent a surface of the TSP segment, e.g., along a top surface or a working surface, such that upon heating and pressurizing during the HPHT process the infiltrant preferentially melts and infiltrates into the TSP part before the catalyst material melts, thereby filling the interstitial regions of the TSP part to partially or completely block the catalyst material from infiltrating therein.

In an example embodiment, the infiltrant material useful for infiltrating the TSP body during the HPHT process can be an inert metal or metal alloy that does not promote diamond graphitization at high temperatures and normal pressures. Such materials preferably have a melting temperature that is lower than the catalyst material used to sinter and form the diamond bonded body. Examples of such infiltrant materials include metals such as Cu, alloys of such metals, and combinations of such metals and their alloys with carbide formers. Examples include TiCu, TiCuNi and the like. Such noted inert metal alloys have the advantage of having a low melting temperature. Additionally, the presence of a carbide former along with the metal or metal alloy contributes to the formation of a carbide during HPHT processing, the presence of such carbide contributes to TSP strengthening.

If desired, the extent of backfilling or infiltrating the TSP part can be controlled to leave a portion of the TSP part uninfiltrated. This can either be done, for example, by careful control of the infiltration process, by select placement/positioning of the infiltrant material adjacent target TSP part surfaces, and by careful control of the total amount of infiltrant material relative to the available TSP pore space, or can be done after the TSP part has been completely infiltrated by treating the TSP part to remove the infiltrant from a targeted region of the TSP part. For example, it may be desired that a surface portion of the TSP part, and possibly a region extending from such surface, not include the infiltrant material for the purpose of providing a desired level of thermal stability, abrasions and/or wear resistance. In an example embodiment, such a surface portion of the TSP part may form a surface portion, such as a working surface, of the final diamond bonded construction.

Additionally, it may be desired that the infiltrant material infiltrate the TSP part only along one or more select surfaces. For example, the infiltrant material can be positioned along a top surface and one or more side surfaces of the TSP part, and not along a bottom surface of the part. In such embodiment, the infiltrant material only partially fills the top and one or more side regions of the TSP part, and not the bottom region. During HPHT processing of the diamond bonded body, the catalyst material used to sinter the diamond bonded body is free to infiltrate the TSP part through the bottom surface, thereby facilitating the formation of a strong attachment between the TSP part and the remaining diamond bonded body. In such an embodiment, the TSP part can either be selectively infiltrated during the HPHT process or can be selectively infiltrated separately from the HPHT process and then subsequently combined with the diamond volume to for HPHT processing. Accordingly, constructions formed according to this embodiment include both the presence of the desired infiltrant material along selected surfaces of the TSP part to provide desired properties at such selected surfaces, e.g., the working surfaces, while also having a strong attachment with the remaining diamond bonded body by infiltration of the catalyst material therein.

Additionally, the one or more TSP parts used to form diamond bonded construction of this invention can be both infiltrated and include a material layer. For example, the TSP part can be completely or partially infiltrated with a desired infiltrant, and further include one or more desired material layers along one or more of its surfaces. The material that is used as the infiltrant can be the same or different from that used to form the material layer.

It is to be understood that treating the TSP part by applying a material layer or by infiltration is optional, and that diamond bonded constructions of this invention can be formed using one or more TSP parts that have not been treated to include a material layer or infiltrated as described above.

The TSP part or parts used to make diamond bonded constructions of this invention can be formed having a diamond grain size, grain size distribution, and/or diamond grain volume that is the same or different than that of the remaining PCD body comprising the TSP part or parts. In an example embodiment, the TSP part is formed using diamond grains that have an average grain size that is different, e.g., smaller, than that of used to form the PCD body. As noted above, the TSP part can also be configured having two or more different regions each having a different diamond grain size and/or a different diamond volume content. Diamond bonded bodies formed using fine-sized diamond grains, e.g., having a nominal diamond grain size of less than amount 10 micrometers, tend to provide superior wear resistance when compared to diamond bonded bodies formed from larger-sized diamond grains.

As described in greater detail below, a feature of diamond bonded constructions of this invention is that they comprise a diamond bonded body having one or more TSP parts disposed therein that are bonded to an adjacent region of the diamond bonded body during the process of forming/sintering the diamond bonded body at HPHT conditions.

Figure 4:
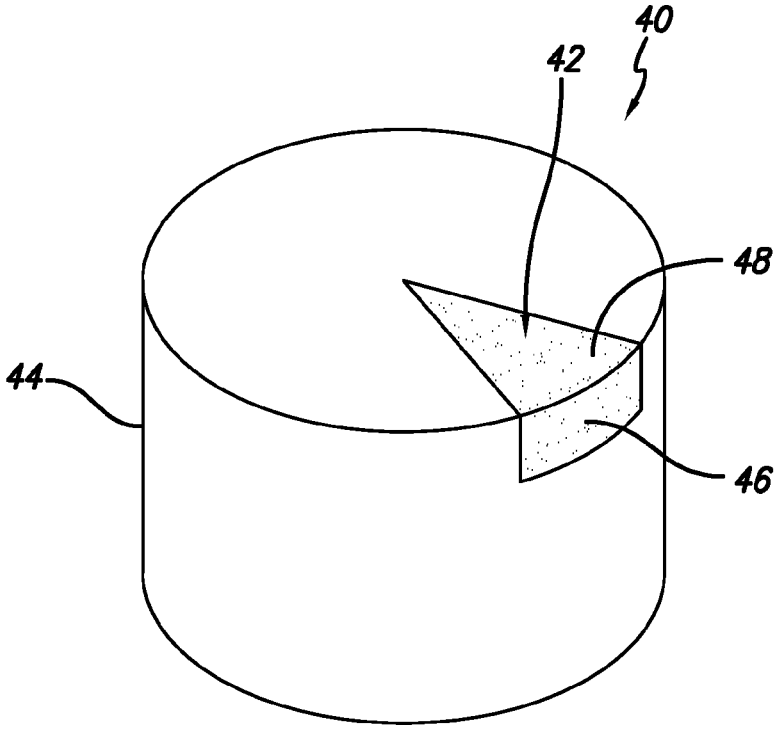
FIG. 4 is perspective view of an example embodiment diamond bonded body of this invention.

FIG. 4 illustrates an example embodiment diamond bonded body 40 comprising a TSP part 42 that is disposed within a PCD body 44. In this particular embodiment, the TSP part 42 is provided in the form of a wedge or pie-shaped part or segment as illustrated in FIG. 2, and is positioned within the body 40 such that a convex shaped peripheral edge 46 of the TSP part 42 forms an edge or a working surface of the body 40. Further, in this particular example, the TSP part 42 includes a top surface 48 that is positioned within the body 44 to form part of the body top surface. Thus, in this embodiment, side and bottom surfaces of the TSP part are positioned within the PCD body and may include a material layer and/or the TSP part may be infiltrated as described above. In this example embodiment, the TSP part is disposed within and bonded to the PCD body, and is not placed into contact with the substrate. The TSP part 42 is bonded to the adjacent regions of the diamond bonded body during the process of sintering the diamond bonded body at HPHT conditions.

While FIG. 4 illustrates an example diamond bonded body comprising only a single TSP part, it is to be understood that the body can be constructed to comprise an number of TSP parts that are configured and positioned to together form a working surface, or that can be configured and/or positioned to form a working surface with a desired rotation of the diamond bonded body, e.g., to place the TSP part into working contact during operation. For example, the TSP body can comprise 2, 3, 4 or any number of such wedge shaped TSP parts that positioned at locations within the body, e.g., 180 degrees, 120 degrees, or 45 degrees apart from one another, to provide a combined single working surface or to provide 2, 3 or 4 different working surfaces upon an associated rotation of the diamond body in a wear and/or cutting operation. It is to be understood that diamond bonded bodies constructed in accordance with principles of the invention can comprise one or any number of such TSP segments or part. As used herein, the term "element", "part", or "segment" is understood to mean a TSP body having a predetermined shape and configuration that is specifically engineered to form all or a portion of the diamond bonded construction working surface.

Further, while FIG. 4 illustrates the placement of the TSP part within the diamond bonded body forming part of the body top surface, it is to be understood that the TSP part or parts used with constructions of this invention can be positioned within the diamond bonded body such that the diamond bonded body covers all or a portion of the TSP part top surface.

TSP parts or segments used to form diamond bonded constructions can be sized and shaped differently depending on the particular end-use application and the configuration of the wear and/or cutting device. A few examples provided by way of reference are illustrated in the figures. In an example embodiment, where the construction is provided in the form of a cutting element used in a bit for drilling subterranean formations, it is desired that each TSP segment be configured to form at least about 5 percent, and preferably 10 percent or more of the of the construction working surface. The construction "working surface" as used herein is understood to be the surface of the cutter that engages or that could engage a formation or object by the end use application, e.g., a drill bit. In some instances, the TSP part can form up to 100 percent of the working surface. Thus, in some applications the total edge or working surface of the construction can be provided by a single TSP part and in others it can be provided by two or more TSP parts. In an example embodiment, the TSP part, element or segment may be configured and positioned to occupy at least about 1 mm along a circumference of the working surface, wherein the working surface is positioned along a peripheral edge of the diamond bonded construction.

Figure 5:
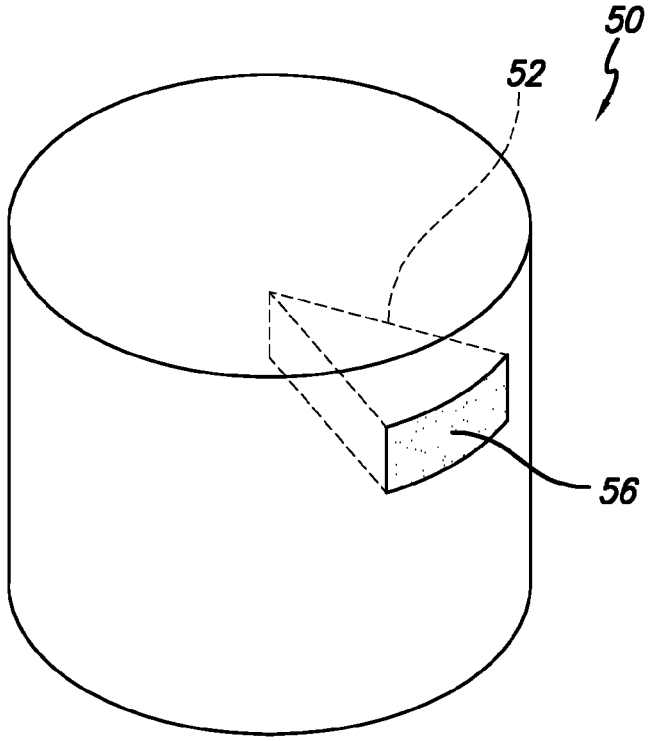
FIG. 5 is a perspective view of another example embodiment diamond bonded body of this invention.

FIG. 5 illustrates an example embodiment diamond bonded body 50 comprising a TSP part 52 that is disposed within a PCD body 54. In this particular embodiment, the TSP part 52 is provided in the form of a wedge or pie-shaped part or segment and is positioned within the body 50 such that a convex shaped peripheral edge 56 of the TSP part 52 forms an edge or working surface of the body 50. Further, the TSP part is positioned within the body such that both the top and bottom surfaces of the TSP part are covered by the PCD material forming the body, i.e., so that only the edge portion of the TSP part is or becomes exposed. The placement depth of the TSP part in such embodiment can and will vary depending on the end-use application.

FIGS. 4 and 5 illustrate embodiments of diamond bonded bodies that comprise one or more TSP parts positioned within the body such that an edge surface of the TSP part is exposed to form an edge surface of the body or a working surface. However, it is to be understood that diamond bonded bodies may include one or more TSP parts that are positioned within the body having an edge surface that is not initially exposed, but that can be exposed and that can form the working surface either before being placed into use, e.g., by removing the adjacent portion of the diamond bonded body by machining process, or after a period of time once placed into use by the wearing away of the adjacent portion of the diamond bonded body during a wear or cutting operation.

Figure 6:
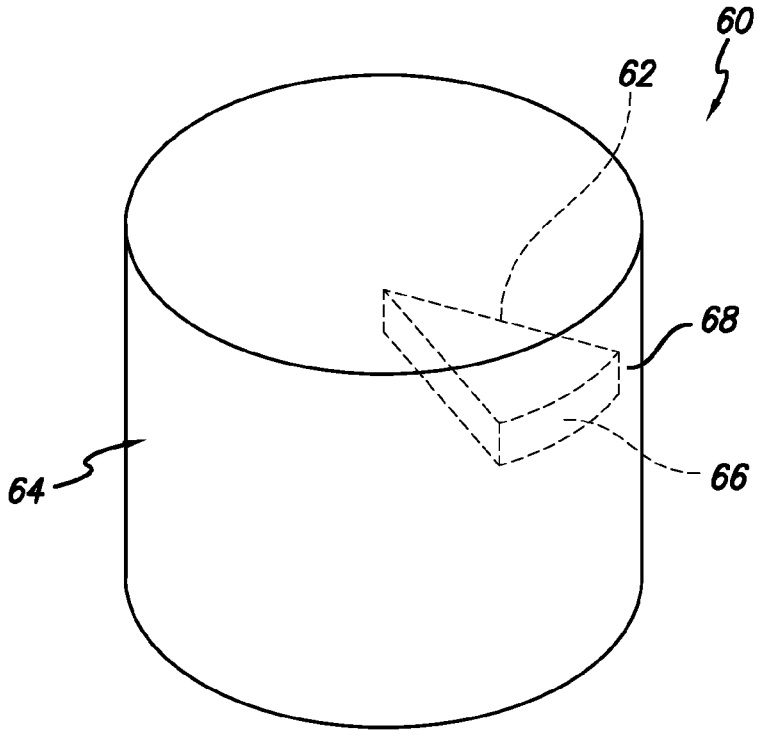
FIG. 6 is a perspective view of another example embodiment diamond bonded body of this invention.

FIG. 6 illustrates an example embodiment diamond bonded body 60 comprising a TSP part 62 that is disposed within a PCD body 64. In this particular embodiment, the TSP part 62 is provided in the form of a wedge or pie-shaped part or segment that is positioned within the body 60 such that an edge 66 of the TSP part is covered by a region of PCD material adjacent an outer edge 68 of the body. In this particular embodiment, the TSP part is positioned so that it is completely surrounded by the PCD material with its top and bottom surfaces covered. In an example embodiment, the TSP part edge 66 can become exposed to form an outer or working surface of the body prior to placing the body into operation by machining process or the like to remove the covering PCD region, or can be exposed after placing the body into operation after a period of time sufficient to remove the covering PCD region.

Figure 7:
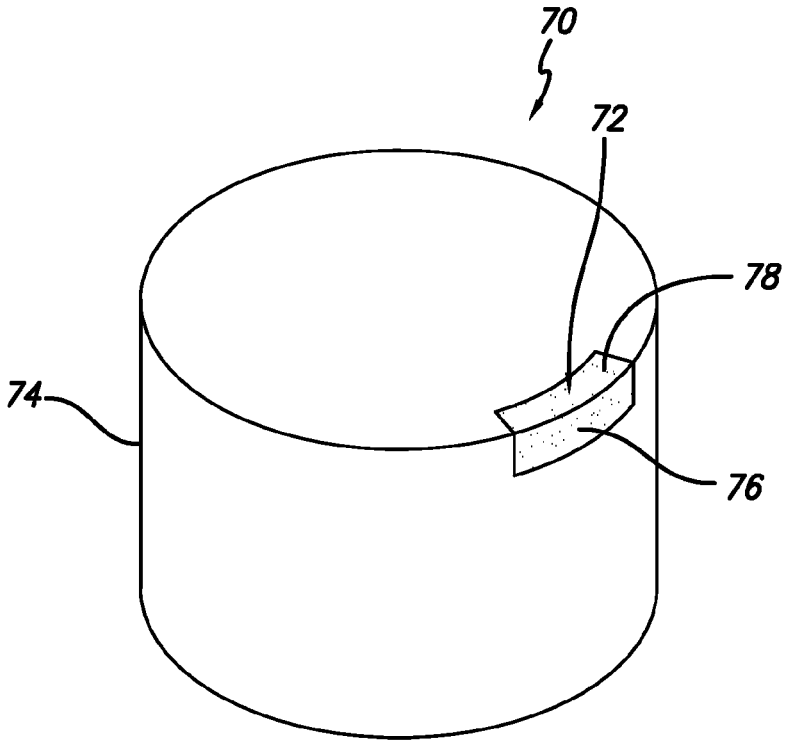
FIG. 7 is a perspective view of another example embodiment diamond bonded body of this invention.

FIG. 7 illustrates an example embodiment diamond bonded body 70 comprising a TSP part 72 that is disposed within a PCD body 74. In this particular embodiment, the TSP part 72 is provided in the form of an annular section that is positioned within the body 74 such that an outside surface 76 of the section forms an outer wall surface of the body adjacent an edge 78 of the body. In this particular embodiment, the TSP part inner wall surface is bonded to the PCD material of the body and is positioned along a wall surface of the body to form a lip during placement of the body in a wear or cutting operation as the body edge 78 becomes worn away.

While the constructions illustrated in FIGS. 4 to 7 do not show the presence of a substrate attached to the diamond bonded body, it is to be understand that such constructions can be configured to include substrates attached to the diamond bonded body. The substrate can be attached during HPHT formation of the diamond bonded body or can be attached by other technique, such as by brazing or welding or the like. Additionally, it is to be understood that the constructions illustrated in FIGS. 4 to 7 may or may not be configured to include one or more material layers and/or infiltrants as described above depending on the particular end use application.

Figure 8:
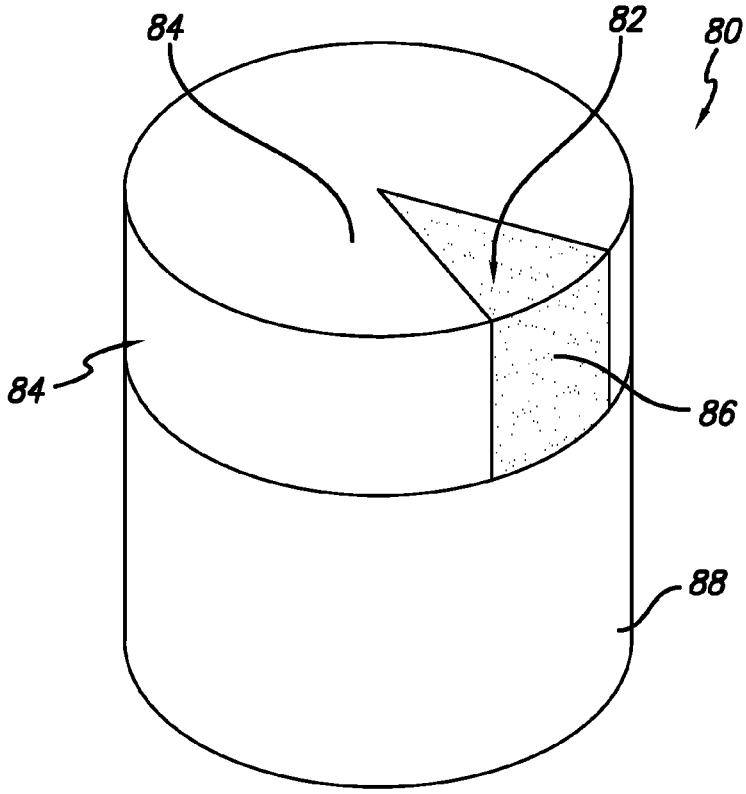
FIG. 8 is perspective view of an example embodiment diamond bonded body of this invention.

FIG. 8. illustrates an example embodiment diamond bonded body 80 comprising a TSP part 82 that is disposed within a PCD body 84. Like the embodiment illustrated in FIG. 4, the TSP part 82 is provided in the form of a wedge or pie-shaped part or segment and is positioned within the body 80 such that a convex-shaped peripheral edge 86 of the TSP part 82 forms an edge and working surface of the body 84. Unlike the embodiment of FIG. 4, the TSP part 82 extends axially within the body 94 to a substrate 88 that is attached to the body. The TSP part can include a material layer and/or may be infiltrated as described above. This example illustrates that the TSP part or parts disposed within the diamond bonded body can extend through the body to a substrate used to form the construction.

Figure 9:
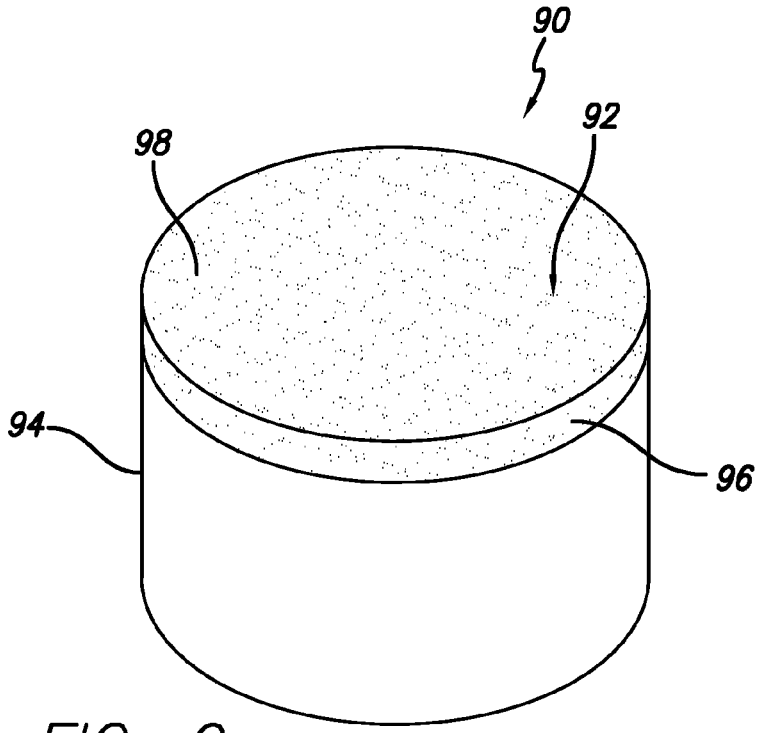
FIG. 9 is a perspective view of another example embodiment diamond bonded body of this invention.

FIG. 9 illustrates an example embodiment diamond bonded body 90 comprising a TSP part 92 that is disposed within a PCD body 94. In this particular embodiment, the TSP part 92 is provided in the form of a solid disk that is positioned within the body 94. The TSP part 92 has a diameter sized to form a peripheral edge 96 or working surface of the PCD body 94. The TSP part 92 includes a top surface 98 that is positioned within the body 94 to form the body top surface. In this embodiment, the bottom surface of the TSP part is positioned within the PCD body and may include a material layer and/or the TSP part may be infiltrated as described above. In this example embodiment, the TSP part is disposed within and bonded to the PCD body, and is not placed into contact with the substrate. The TSP part 92 is bonded to the adjacent region of the diamond bonded body during the process of sintering the diamond bonded body at HPHT conditions.

While the TSP part shown in FIG. 9 is illustrated having a particular configuration, e.g., in the form of a solid disk, it is to be understood that other TSP part shapes can be used for forming diamond bonded constructions of this invention. For example, the TSP part can be provided in the form of an annular ring, or an arc-shaped section, having an outside diameter that is sized to permit placement within the diamond bonded body to form a working surface along a peripheral edge of the construction. Such a TSP ring or arc-shaped section can be positioned at the top of the body or a desired depth below the body top surface, depending on the particular end-use application.

Further, although the TSP parts described above and shown in the figures have been illustrated as having generally smooth surfaces, it is to be understood that the TSP parts used in making diamond bonded constructions can comprise one or more surface features to provide a nonplanar interface with an adjacent region of the PCD material, which can provide additional strength to the attachment between the TSP part and the adjacent PCD body region. Still further, while certain TSP part configurations and placements within the diamond bonded body have been described and illustrated, it is to be understood that the exact TSP part configuration and placement position can and will vary depending on the particular construction geometry and the end-use application.

As illustrated in FIG. 8, diamond bonded constructions of this invention generally comprise a diamond bonded body, comprising one or more TSP parts or segments disposed therein, that is attached to a substrate. Accordingly, it is to be understood that the example diamond bonded bodies illustrated in FIGS. 4 to 7 and 9 are preferably attached to a substrate to form a diamond bonded construction that will facilitate attachment with a desired end use device, e.g., by welding or brazing attachment.

Substrates useful for forming diamond bonded-constructions can be the same as those used to form conventional PCD materials, such a metallic materials, ceramic materials, cermet materials, and combinations thereof. The substrate can be attached to the body either during the process of forming the diamond bonded body by HPHT processing, or can be attached to the body after it has been formed by welding, brazing or other such techniques.

In an example embodiment, where the substrate is attached to the body during the HPHT process used to form the body including the TSP part, it is desired that the substrate material comprise a metallic material capable of both facilitating a bonded attachment with the body and supplying a catalyst material to the diamond volume used to sinter the PCD body during such HPHT processing. In a preferred embodiment, a useful substrate is formed from WC—Co. The substrate can be provided in powder form, as a green state part, or can be provided in the form of an already-sintered part.

In an example embodiment, diamond bonded construction of this invention are prepared by placing the one or more TSP parts formed in the manner noted above into a desired region within a volume of diamond powder disposed within a suitable HPHT container. In an example embodiment, the TSP part or parts are positioned within the diamond volume to provide a desired placement position within the resulting PCD body to form an outer or working surface of the body. A substrate is positioned adjacent the diamond volume and comprises a catalyst material capable of infiltrating into the diamond volume during the HPHT process. The container can be formed from those materials conventionally used to form PCD, such as niobium, tantalum, molybdenum, zirconium, mixtures thereof and the like.

The container is then loaded into a HPHT device, such as that used to form conventional PCD, and the device is operated to subject the contents of the container to a desired HPHT condition for a designated period of time. In an example embodiment, the container can be subjected to the same HPHT conditions as described above for the first HPHT cycle for forming the PCD material used to form the TSP part or parts.

A feature of diamond bonded constructions prepared in accordance with the invention is the inclusion of a TSP part or segment within a diamond bonded body during the process of making the diamond body, e.g., comprising PCD, to provide desired properties of wear and abrasion resistance to the construction while not otherwise sacrificing desired properties such as toughness. A further feature of such constructions is that it enables one to engineer, position, and configure a desired outer surface or working surface made from TSP within a PCD body to specifically meet the wear and/or cutting demands of a particular end-use application, providing desired wear resistant and abrasion resistant properties where they are more needed while retaining desired toughness adjacent the wear surface and within remaining portions of the body, and while achieving a strong attachment with between the TSP part and the diamond bonded body.

Diamond bonded constructions of this invention can be used in a number of different applications, such as tools for mining, cutting, machining, milling and construction applications, wherein properties of shear strength, thermal stability, wear and abrasion resistance, mechanical strength, and/or reduced thermal residual stress at and/or adjacent the working surface are highly desired. Constructions of this invention are particularly well suited for forming working, wear and/or cutting elements in machine tools and drill and mining bits such as roller cone rock bits, percussion or hammer bits, diamond bits, and shear cutters used in subterranean drilling applications.

Figure 10:
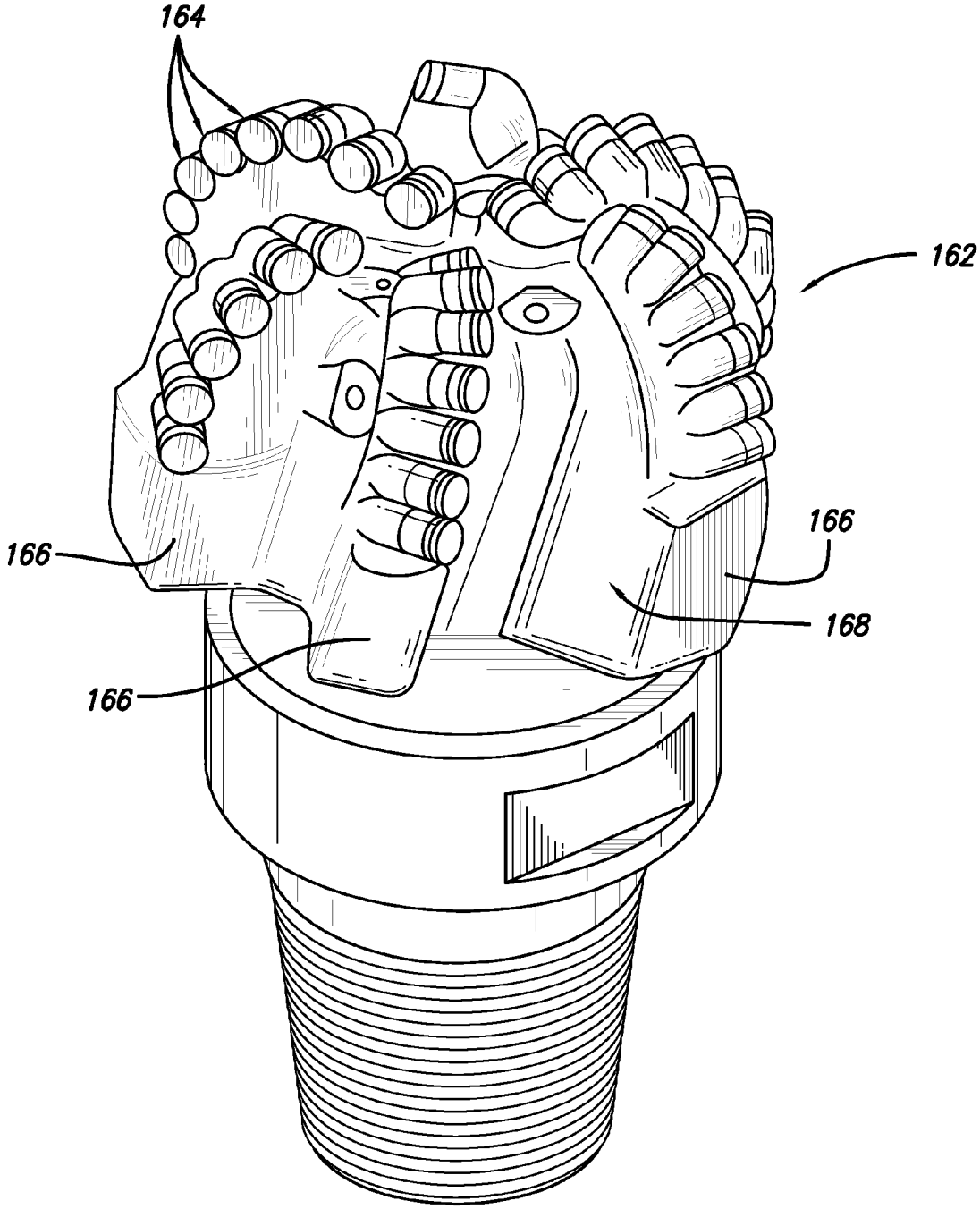
FIG. 10 is a perspective side view of a drag bit comprising a number of the ultra-hard and metallic constructions of this invention provided in the form of a shear cutter.

FIG. 10 illustrates a drag bit 162 comprising a plurality of cutting elements made from ultra-hard and metallic constructions of this invention configured in the form of shear cutters 164. The shear cutters 164 are each attached to blades 166 that extend from a head 168 of the drag bit for cutting against the subterranean formation being drilled. The shear cutters 164 are attached by conventional welding or brazing technique to the blades and are positioned to provide a desired cutting surface.

Figure 11:
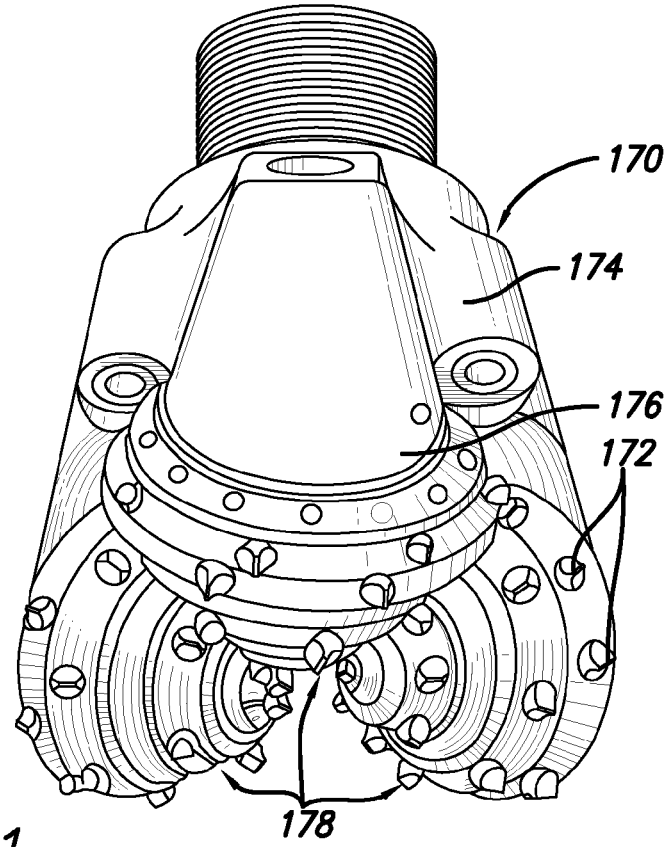
FIG. 11 is a perspective side view of a rotary cone drill bit comprising a number of the ultra-hard and metallic constructions of this invention provided in the form of inserts.

FIG. 11 illustrates a rotary or roller cone drill bit in the form of a rock bit 170 comprising a number of the ultra-hard and metallic constructions of this invention provided in the form of wear or cutting inserts 172. The rock bit 170 comprises a body 174 having three legs 176, and a roller cutter cone 178 mounted on a lower end of each leg. The inserts 172 can be formed according to the methods described above. The inserts 172 are provided in the surfaces of each cutter cone 178 for bearing on a rock formation being drilled. In an example embodiment, the inserts can be positioned along the gage and/or heel row of the drill bit.

Figure 12:
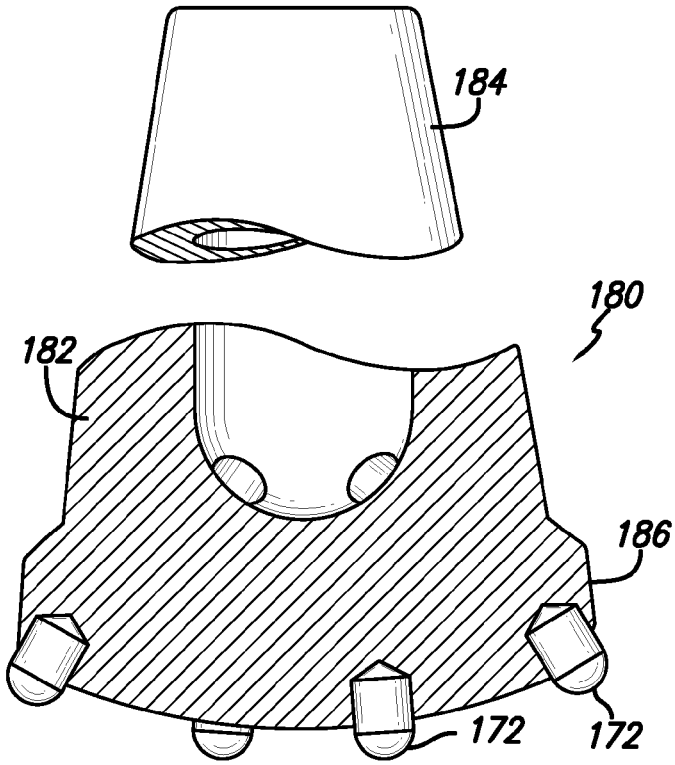
FIG. 12 is a perspective side view of a percussion or hammer bit comprising a number of the ultra-hard and metallic constructions of this invention provided in the form of inserts.

FIG. 12 illustrates the inserts described above as used with a percussion or hammer bit 180. The hammer bit comprises a hollow steel body 182 having a threaded pin 184 on an end of the body for assembling the bit onto a drill string (not shown) for drilling oil wells and the like. A plurality of the inserts 172 are provided in the surface of a head 186 of the body 182 for bearing on the subterranean formation being drilled.

Other modifications and variations of ultra-hard and metallic constructions of this invention will be apparent to those skilled in the art. It is, therefore, to be understood that within the scope of the appended claims, this invention may be practiced otherwise than as specifically described.

What is claimed is:

1. A method for making a diamond bonded construction comprising:

forming a thermally stable diamond element from a polycrystalline diamond material, the polycrystalline diamond material comprising a plurality of bonded-together diamond grains with a catalyst material disposed within interstitial regions between the diamond grains, wherein the method of forming comprises removing the catalyst from the interstitial regions, and wherein the thermally stable diamond element has a predetermined configuration to form at least part of a working surface of the construction;

combining the thermally stable diamond element with a volume of diamond grains to form an assembly;

subjecting the assembly to high pressure/high temperature conditions to sinter the volume of diamond grains to form a polycrystalline diamond body;

wherein the thermally stable diamond element is disposed within and bonded to the polycrystalline diamond body, and wherein the thermally stable diamond element forms at least a portion of the diamond bonded construction working surface.

2. The method as recited in claim 1 further comprising the step of treating the thermally stable diamond element to include a material that resists infiltration of a catalyst material used during the step of subjecting.

3. The method as recited in claim 2 wherein the step of treating comprises coating a surface of the thermally stable diamond element with a material that resists infiltration of the catalyst material.

4. The method as recited in claim 2 wherein the step of treating comprises introducing an infiltrant material into the thermally stable diamond element.

5. The method as recited in claim 4 wherein the infiltrant material has a melting temperature that is less than that of the catalyst material.

6. The method as recited in claim 4 wherein the infiltrant material forms a reaction product with the thermally stable diamond element.

7. The method as recited in claim 4 wherein the during the step of treating, the infiltrant enters an adjacent region of the thermally stable diamond element, and wherein during the step of subjecting the catalyst material enters an different adjacent region of the thermally stable diamond element.

8. The method as recited in claim 4 wherein the infiltrant is introduced into the thermally stable diamond element under the high pressure/high temperature conditions used to form the polycrystalline diamond body.

9. The method as recited in claim 1 wherein thermally stable diamond element is in the form of a segment that occupies a partial portion of the construction working surface.

10. The method as recited in claim 9 wherein the thermally stable diamond element occupies at least 5 percent of the construction working surface.

11. The method as recited in claim 9 wherein the thermally stable diamond element occupies 10 percent or more of the construction working surface.

12. The method as recited in claim 9 wherein the construction comprises two or more segments positioned within the polycrystalline diamond body.

13. The method as recited in claim 1 wherein the thermally stable diamond element occupies at least about 1 mm of a circumference of the construction working surface positioned along a peripheral edge of the working surface.

14. The method as recited in claim 1 wherein the thermally stable diamond element is positioned within the polycrystalline diamond body to form an edge surface of the construction.

15. The method as recited in claim 1 wherein the thermally stable diamond element is positioned within the body such that a top and bottom surface of the element is covered by the body.

16. The method as recited in claim 1 wherein the thermally stable diamond element is provided in the form of a disk positioned in the body so a top surface of the element forms a top surface of the construction.

17. The method as recited in claim 1 where during the step of subjecting the diamond body is attached to a metallic substrate.

18. The method as recited in claim 1 wherein the thermally stable diamond element is in contact with the substrate.

19. The method as recited in claim 1 wherein the thermally stable diamond element comprises a first region adjacent a top surface of the element and a second region adjacent a bottom surface of the element, wherein the first and second regions include differently sized diamond grains.

20. The method as recited in claim 1 wherein the thermally stable diamond element comprises a first region adjacent a top surface of the element and a second region adjacent a bottom surface of the element, wherein the first and second regions have a different diamond volume content.

21. The method as recited in claim 1 wherein the thermally stable diamond element comprises diamond grains that are sized differently from diamond grains used to form the body.

22. The method as recited in claim 1 further comprising the step of treating a surface of the construction to remove a material from the interstitial regions of one or both of the thermally stable element and diamond bonded body.

23. A bit for drilling subterranean formations comprising a body and a number of cutting elements operatively attached to the body, wherein the cutting elements comprise the diamond bonded construction made according to the method recited in claim 1.

24. A diamond bonded construction comprising:

a sintered polycrystalline diamond body comprising a matrix phase of bonded-together diamond grains and a plurality of interstitial regions disposed between the diamond grains and comprising a catalyst material used to form the diamond body disposed therein;

a thermally stable diamond element disposed within the diamond body, wherein the thermally stable diamond element has a predetermined configuration and is positioned within the body to form at least part of a working surface of the construction, and wherein the thermally stable diamond element comprises a plurality of bonded-together diamond grains and interstitial regions, wherein the interstitial regions are substantially free of a catalyst material used to sinter the thermally stable diamond element, and wherein the thermally stable diamond element is bonded to the diamond body; and a substrate bonded to the polycrystalline diamond body;

wherein the thermally stable diamond element extends along 1 mm or more of the construction working surface taken along a circumference of a peripheral edge of the construction.

25. The construction as recited in claim 24 wherein the thermally stable diamond element forms a partial portion of the working surface that is at least 5 percent of the total working surface.

26. The construction as recited in claim 24 wherein the thermally stable diamond element is positioned within the polycrystalline diamond body to form an edge surface of the construction.

27. The construction as recited in claim 24 wherein the thermally stable diamond element comprises a first diamond region adjacent a top surface of the element and a second diamond region adjacent a bottom surface of the element, and wherein the first and second diamond regions are formed from differently sized diamond grains.

28. The construction as recited in claim 24 wherein the thermally stable diamond element comprises a first diamond region adjacent a top surface of the element and a second diamond region adjacent a bottom surface of the element, and wherein the first and second diamond regions comprise a different diamond volume content.

29. The construction as recited in claim 24 wherein the thermally stable diamond element includes a top and bottom surface, and wherein the top and bottom surface are in contact with the polycrystalline diamond body.

30. The construction as recited in claim 24 wherein the thermally stable diamond element includes a top and bottom surface, and wherein the bottom surface is in contact with the substrate.

31. The construction as recited in claim 24 wherein the thermally stable diamond element forms a top surface of the construction.

32. The construction as recited in claim 24 wherein the thermally stable diamond element comprises one or more segments.

33. The construction as recited in claim 24 wherein the thermally stable diamond element defines at least a portion of a top surface of the construction.

34. The construction as recited in claim 24 wherein the thermally stable diamond element defines at least a portion of a peripheral edge of the construction.

35. A bit for drilling subterranean formations comprising a body and a number of cutting elements operatively attached thereto, the cutting elements comprising a diamond bonded construction as recited in claim 24.

36. A diamond bonded construction comprising:

a sintered polycrystalline diamond body comprising a matrix phase of bonded-together diamond grains and a plurality of interstitial regions disposed between the diamond grains and comprising a catalyst material used to form the diamond body disposed therein;

a thermally stable diamond element disposed within the diamond body, wherein the thermally stable diamond element has a predetermined configuration and is positioned within the body to form at least part of a working surface of the construction, and wherein the thermally stable diamond element comprises a plurality of bonded-together diamond grains and interstitial regions, wherein the interstitial regions are substantially free of a catalyst material used to sinter the thermally stable diamond element, and wherein the thermally stable diamond element is bonded to the diamond body; and a substrate bonded to the polycrystalline diamond body;

wherein the thermally stable diamond element comprises one or more segments; and wherein the segment has a constant axial thickness as measured between a segment top and bottom surface.

37. A diamond bonded construction comprising:

a sintered polycrystalline diamond body comprising a matrix phase of bonded-together diamond grains and a plurality of interstitial regions disposed between the diamond grains and comprising a catalyst material used to form the diamond body disposed therein;

a thermally stable diamond element disposed within the diamond body, wherein the thermally stable diamond element has a predetermined configuration and is positioned within the body to form at least part of a working surface of the construction, and wherein the thermally stable diamond element comprises a plurality of bonded-together diamond grains and interstitial regions, wherein the interstitial regions are substantially free of a catalyst material used to sinter the thermally stable diamond element, and wherein the thermally stable diamond element is bonded to the diamond body; and a substrate bonded to the polycrystalline diamond body;

wherein the thermally stable diamond element comprises a nondiamond material positioned along at least one of its surfaces; and wherein the nondiamond material has a melting temperature that is greater than that of the catalyst material.

38. The construction as recited in claim 37 wherein the nondiamond material is disposed within the interstitial regions of the thermally stable diamond element.

39. The construction as recited in claim 37 wherein the nondiamond material is selected from the group consisting of carbide formers.

40. The construction as recited in claim 37 wherein at least one of the thermally stable diamond element surfaces does not include the nondiamond material and includes the catalyst material.

41. A bit for drilling subterranean formations comprising:

a body and a number of blades extending outwardly therefrom;

a number of cutting elements attached to the blades, at least one of the cutting elements including a diamond bonded construction comprising:

a sintered polycrystalline diamond body having a matrix phase of bonded-together diamond grains and a plurality of interstitial regions disposed between the diamond grains and comprising a catalyst material disposed therein;

a thermally stable diamond element disposed within the diamond body, wherein the thermally stable diamond element has a predetermined configuration and is positioned within the body to form a working surface of the construction, and wherein the thermally stable diamond element comprises a plurality of bonded-together diamond grains and interstitial regions, wherein the interstitial regions are substantially free of a catalyst material used to make the thermally stable diamond element, and wherein the thermally stable diamond element is bonded to the diamond body, the thermally stable diamond element further comprising means for reducing infiltration of the catalyst material from the polycrystalline diamond body therein; and a substrate bonded to the polycrystalline diamond body wherein the thermally stable diamond element further comprises means for reducing infiltration of the catalyst material therein, wherein the means for reducing infiltration comprises an infiltrant material disposed within the interstitial regions of the thermally stable diamond element.

42. The bit as recited in claim 41 wherein the thermally stable diamond element is provided in the form of a segment occupying a partial portion of a working surface of the polycrystalline diamond body.

43. The bit as recited in claim 42 wherein the segment defines at least about 5 percent of the construction working surface.

44. The bit as recited in claim 43 wherein the segment occupies 10 percent or more of the construction working surface.

45. The bit as recited in claim 43 wherein the segment occupies at least about 1 mm of a total circumference of the construction as measured along a peripheral edge.

46. The bit as recited in claim 41 wherein the infiltrant material has a melting temperature that is less than that of the catalyst material.

47. The bit as recited in claim 41 wherein a region of the thermally stable diamond element adjacent at least one surface of the element is substantially free of the infiltrant material and comprises the catalyst material.

48. The bit as recited in claim 41 wherein the thermally stable diamond element comprises a first diamond region adjacent an element top surface, and a second diamond region adjacent an element bottom surface, and wherein the first and second diamond regions are formed from differently sized diamond grains.

49. The bit as recited in claim 41 wherein the thermally stable diamond element comprises a first diamond region adjacent an element top surface, and a second diamond region adjacent an element bottom surface, and wherein the first and second diamond regions comprise a different diamond volume content.

50. The bit as recited in claim 41 wherein the thermally stable diamond element comprises a disk-shaped body that defines a top surface of the construction.

51. The bit as recited in claim 41 wherein a top portion of the thermally stable diamond element is in contact with the polycrystalline diamond body.

* * * * *